US008952885B2

(12) United States Patent
Suwabe et al.

(10) Patent No.: US 8,952,885 B2
(45) Date of Patent: Feb. 10, 2015

(54) DRIVING DEVICE FOR DRIVING DISPLAY MEDIUM, DISPLAY DEVICE, METHOD OF DRIVING DISPLAY MEDIUM, AND DISPLAY METHOD

(71) Applicant: Fuji Xerox Co., Ltd., Tokyo (JP)

(72) Inventors: Yasufumi Suwabe, Kanagawa (JP); Yoshinori Machida, Kanagawa (JP); Masaaki Abe, Kanagawa (JP)

(73) Assignee: Fuji Xerox Co., Ltd., Tokyo (JP)

( * ) Notice: Subject to any disclaimer, the term of this patent is extended or adjusted under 35 U.S.C. 154(b) by 51 days.

(21) Appl. No.: 13/846,039

(22) Filed: Mar. 18, 2013

(65) Prior Publication Data

US 2013/0321381 A1 Dec. 5, 2013

(30) Foreign Application Priority Data

May 31, 2012 (JP) ..... 2012-124330

(51) Int. Cl.
*G09G 3/34* (2006.01)
*G09G 3/20* (2006.01)

(52) U.S. Cl.
CPC ..... *G09G 3/20* (2013.01); *G09G 3/3446* (2013.01); *G09G 3/2003* (2013.01); *G09G 2310/061* (2013.01); *G09G 2340/16* (2013.01)
USPC ..... 345/107; 345/212

(58) Field of Classification Search
USPC ..... 345/87, 107, 212
See application file for complete search history.

(56) References Cited

U.S. PATENT DOCUMENTS

2012/0069064 A1 * 3/2012 Yamakita ..... 345/690

FOREIGN PATENT DOCUMENTS

JP A-2010-181548 8/2010
JP A-2011-186146 9/2011

* cited by examiner

*Primary Examiner* — Ricardo L Osorio
(74) *Attorney, Agent, or Firm* — Oliff PLC

(57) ABSTRACT

There is provided a driving device for driving a display medium that includes a pair of substrates and plural particle groups which are provided between the pair of substrates and have different colors and different threshold voltages for separation from the substrates, including an application unit that applies reset voltages for moving the plural particle groups to one of the pair of substrates between the substrates, each reset voltage being different from each other according to each of the plural particle groups.

21 Claims, 52 Drawing Sheets

DRIVING DEVICE FOR DRIVING DISPLAY MEDIUM, DISPLAY DEVICE, METHOD OF DRIVING DISPLAY MEDIUM, AND DISPLAY METHOD

CROSS-REFERENCE TO RELATED APPLICATIONS

This application is based on and claims priority under 35 USC 119 from Japanese Patent Application No. 2012-124330 filed May 31, 2012.

BACKGROUND

Technical Field

The present invention relates to a driving device for driving a display medium, a display device, a method of driving a display medium, and a display method.

SUMMARY

According to an aspect of the invention, there is provided a driving device for driving a display medium that includes a pair of substrates and plural particle groups which are provided between the pair of substrates and have different colors and different threshold voltages for separation from the substrates, including an application unit that applies reset voltages for moving the plural particle groups to one of the pair of substrates between the substrates, each reset voltage being different from each other according to each of the plural particle groups.

BRIEF DESCRIPTION OF THE DRAWINGS

Exemplary embodiments of the present invention will be described in detail based on the following figures, wherein.

DETAILED DESCRIPTION

First Exemplary Embodiment

Figure 1A:
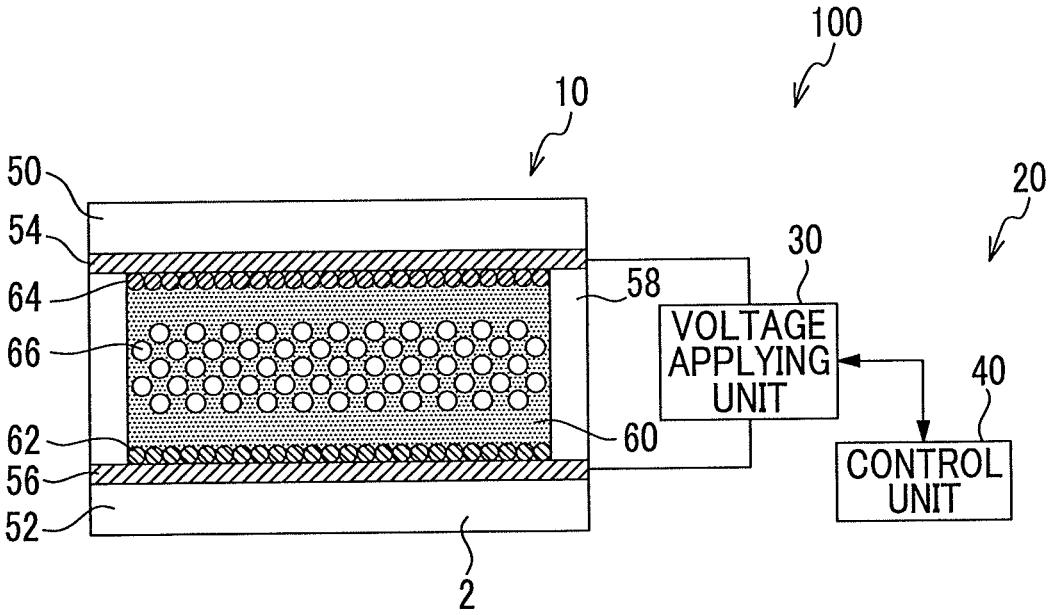
FIG. 1A is a schematic block diagram illustrating the structure of a display device.

Hereinafter, a first exemplary embodiment will be described with reference to the accompanying drawings. For simplicity of explanation, this exemplary embodiment will be described using the drawings in which attention is paid to an appropriate cell.

A particle of red is represented by a red particle R, a particle of cyan, which is the complementary color of red, is represented by a cyan particle C, and a particle of white is represented by a white particle W. Each particle and a particle group including the particles are denoted by the same reference numeral (symbol).

FIG. 1A schematically shows a display device according to this exemplary embodiment. A display device 100 includes a display medium 10 and a driving device 20 that drives the display medium 10. The driving device 20 includes a voltage applying unit 30 that applies a voltage to the display medium 10 and a control unit 40 that controls the voltage applying unit 30 according to image information about an image to be displayed on the display medium 10.

In the display medium 10, a display substrate 50 which is an image display surface and has translucency and a rear substrate 52 which is a non-display surface face each other with a gap therebetween. A display-side electrode 54 which has translucency is formed on the display substrate 50 and a rear-surface-side electrode 56 is formed on the rear substrate 52. The display-side electrode 54 and the rear-surface-side electrode 56 may not be provided on the display substrate 50 and the rear substrate 52, but may be external electrodes.

The display medium 10 includes spacers 58 that maintain a predetermined gap between the display substrate 50 and the rear substrate 52 and partitions a space between the substrates into plural cells.

The cell indicates a region surrounded by the display substrate 50 having the display-side electrode 54 provided thereon, the rear substrate 52 having the rear-surface-side electrode 56 provided thereon, and the spacers 58. A layer including a protective film or an insulating material may be provided on the surface of each electrode. For example, a dispersion medium 60 including an insulating liquid, and a first particle group 62, a second particle group 64, and a white particle group 66 dispersed in the dispersion medium 60 are sealed in the cell.

The first particle group 62 and the second particle group 64 are characterized in that they have different colors and different threshold voltages which generate the electric field for separation from the substrate and a threshold voltage for generating an electric field equal to or more than a predetermined threshold electric field between the display-side electrode 54 and the rear-surface-side electrode 56 is applied such that the first particle group 62 and the second particle group 64 migrate independently. The white particle group 66 is a floating particle group that has a smaller amount of charge than the first particle group 62 and the second particle group 64 and does not migrate to any electrode even when a voltage which generates the electric field for moving the first particle group 62 and the second particle group 64 to one of the two electrodes is applied.

The white particle group 66 may not be used and a coloring agent may be mixed with the dispersion medium 60 to display white.

In this exemplary embodiment, the first particle group 62 includes positively-charged electrophoresis particles (cyan particles C) of cyan and the second particle group 64 includes positively-charged electrophoresis particles (red particles R) of red, which is the complementary color of cyan, but the invention is not limited thereto. The color or diameter of each particle may be appropriately set. In the following description, the value of the voltage applied is an illustrative example and is not limited thereto. The value of the voltage may be appropriately set according to, for example, the polarity of each charged particle, a particle diameter, a response, and the distance between the electrodes.

The driving device 20 (the voltage applying unit 30 and the control unit 40) applies a voltage corresponding to the color to be displayed between the display-side electrode 54 and the rear-surface-side electrode 56 of the display medium 10 to move the first and second particle groups 62 and 64 and attract the first and second particle groups 62 and 64 to one of the display substrate 50 and the rear substrate 52 according to the polarity of each charged particle.

The voltage applying unit 30 is electrically connected to the display-side electrode 54 and the rear-surface-side electrode 56. In addition, the voltage applying unit 30 is connected to the control unit 40 such that signals are transmitted and received therebetween.

Figure 1B:
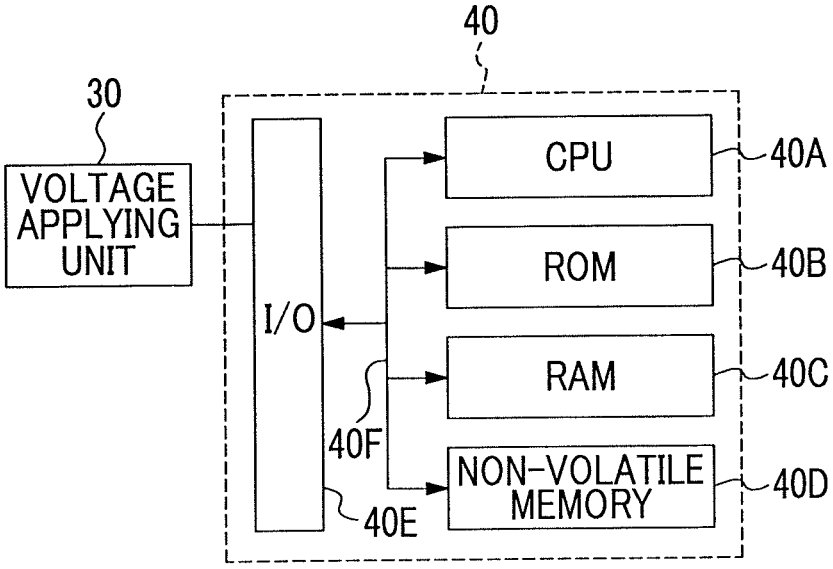
FIG. 1B is a block diagram illustrating a control unit which is formed by a computer.

As shown in FIG. 1B, the control unit 40 is, for example, a computer 40. The computer 40 includes a CPU (Central Processing Unit) 40A, a ROM (Read Only Memory) 40B, a RAM (Random Access Memory) 40C, a non-volatile memory 40D, and an input/output interface (I/O) 40E which are connected to each other through a bus 40F. The voltage applying unit 30 is connected to the I/O 40E. In this case, a program which causes the computer 40 to perform a process for instructing the voltage applying unit 30 to apply a voltage required to display each color, which will be described below, is written to, for example, the non-volatile memory 40D. Then, the program is read from the CPU 40A and is then executed. In addition, the program may be provided by a recording medium such as a CD-ROM.

The voltage applying unit 30 is a voltage applying device for applying a voltage to the display-side electrode 54 and the rear-surface-side electrode 56 and applies a voltage corresponding to the control of the control unit 40 to the display-side electrode 54 and the rear-surface-side electrode 56.

In this exemplary embodiment, for example, an electrode structure corresponding to active matrix driving is used in which the display-side electrode 54 is a common electrode that is formed on the entire display substrate 50 and the rear-surface-side electrode 56 includes plural isolated electrodes. Therefore, in this exemplary embodiment, a case in which the display-side electrode 54 serving as the common electrode is connected to the ground and a voltage corresponding to an image is applied to the plural isolated electrodes of the rear-surface-side electrode 56 will be described.

Figure 2:
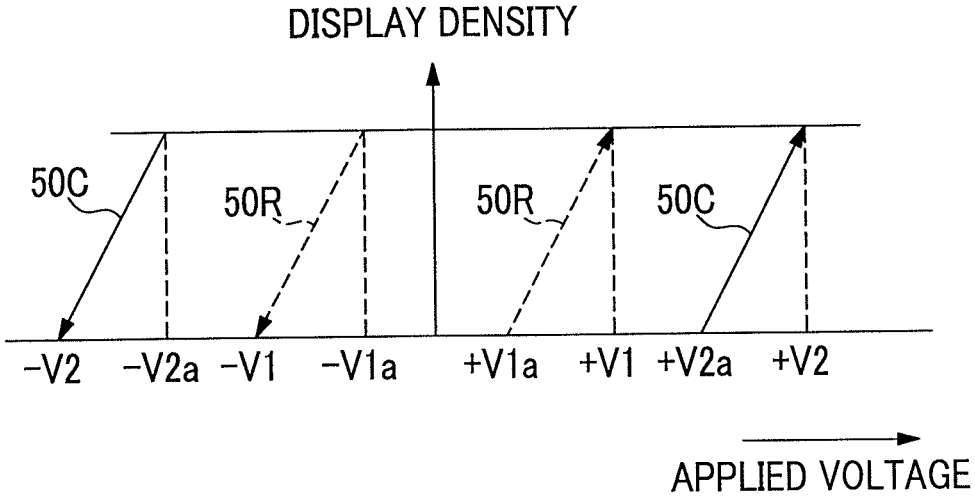
FIG. 2 is a diagram illustrating the voltage application characteristics of each migration particle according to a first exemplary embodiment.

FIG. 2 shows display density characteristics (voltage-display density characteristics) for a voltage which is applied to move the positively-charged cyan particle C and the positively-charged red particle R to the display substrate 50 and the rear substrate 52, respectively, in the display device 100 according to this exemplary embodiment. In FIG. 2, the voltage-display density characteristics of the cyan particle C are represented by characteristics 50C and the voltage-display density characteristics of the red particle R are represented by the characteristics 50R. FIG. 2 shows the relationship between the voltage applied to the rear-surface-side electrode 56 with the display-side electrode 54 grounded (0 V) and display density by each particle group.

In practice, external force F which is applied to move each particle group is represented by an electric field E× the amount of charge q (F=qE) and the characteristics vary depending on the intensity of the electric field. However, for simplicity of explanation, a voltage V will be described on the assumption that the distance d between the display-side electrode 54 and the rear-surface-side electrode 56 is constant. When a display medium in which the distance d between the display-side electrode 54 and the rear-surface-side electrode 56 is different is used, the electric field E is represented by E=V/d and the voltage V may increase as the distance d increases. The voltage-display density characteristics of the particles are similar to each other even when the magnitude of the absolute value of the voltage is changed.

As shown in FIG. 2, a movement start voltage for generating an electric field which causes the cyan particle C close to the rear substrate 52 to start to move to the display substrate 50 is +V2*a*, and a movement start voltage for generating an electric field which causes the cyan particle C close to the display substrate 50 to start to move to the rear substrate 52 is −V2*a*. Therefore, when a voltage equal to or higher than +V2*a* is applied, the cyan particle C close to the rear substrate 52 moves to the display substrate 50. When a voltage equal to or lower than −V2*a* is applied, the cyan particle C close to the display substrate 50 moves to the rear substrate 52. In addition, a threshold voltage for generating an electric field which causes all cyan particles C close to the rear substrate 52 to move to the display substrate 50 is +V2, and a threshold voltage for generating an electric field which causes all cyan particles C close to the display substrate 50 to move to the rear substrate 52 is −V2.

For example, when the pulse width (voltage application time) of the voltage applied is the same, the number of cyan particles C moving from the rear substrate 52 to the display substrate 50 is controlled by changing the value of the voltage applied (voltage value modulation). For example, when the number of cyan particles C moving from the rear substrate 52 to the display substrate 50 is controlled, the pulse width of the voltage applied is the same and the voltage value is set to an arbitrary value equal to or more than +V2*a*, thereby moving the number of cyan particles C corresponding to the voltage value to the display substrate 50. In this way, the gradation display of the cyan particles C is controlled. This holds for the number of particles when the cyan particles C close to the display substrate 50 move to the rear substrate 52.

A movement start voltage (threshold voltage) for generating an electric field which causes the red particle R close to the rear substrate 52 to start to move to the display substrate 50 is +V1*a* and a movement start voltage for generating an electric field which causes the red particle R close to the display substrate 50 to start to move to the rear substrate 52 is −V1*a*. Therefore, when a voltage equal to or higher than +V1*a* is applied, the red particle R close to the rear substrate 52 moves to the display substrate 50. When a voltage equal to or lower than −V1*a* is applied, the red particles R close to the display substrate 50 move to the rear substrate 52. In addition, a threshold voltage for generating an electric field which causes all red particles R close to the rear substrate 52 to move to the display substrate 50 is +V1 and a threshold voltage for generating an electric field which causes all red particles R close to the display substrate 50 to move the rear substrate 52 is −V1. As shown in FIG. 2, $|V1|<|V2|$ is satisfied and the absolute value of the value of the threshold voltage of the cyan particle C is greater than that of the value of the threshold voltage of the red particle R.

Similarly to the cyan particle C, for example, when the pulse width of the voltage applied is the same, the number of red particles R moving from the rear substrate 52 to the display substrate 50 and the number of red particles R moving from the display substrate 50 to the rear substrate 52 are controlled by the value of the voltage applied.

The value of the voltage applied may be the same and the pulse width may be changed to control the number of moving particles, thereby controlling gradation display (pulse width modulation). For example, during the control of the number of cyan particles C moving from the rear substrate 52 to the display substrate 50, when the value of the voltage applied is a predetermined voltage value equal to or greater than +V2*a*, the number of cyan particles C moving to the display substrate 50 increases as the pulse width increases. Therefore, when the voltage value is fixed and the pulse width has a value corresponding to gradation, the gradation display of the cyan particle C is controlled. In this exemplary embodiment, for example, a case in which the number of moving particles is controlled by voltage value modulation will be described.

Next, as the operation of this exemplary embodiment, a control operation performed by the CPU 40A of the control unit 40 will be described with reference to the flowchart shown in FIG. 3.

First, in Step S10, image information about the image to be displayed on the display medium 10 is acquired from an external apparatus (not shown) through the I/O 40E.

In Step S12, the CPU 40A instructs the voltage applying unit 30 to apply a reset voltage. The reset voltage is used to move all of the particle groups having the same color to the display substrate 50 or the rear substrate 52, thereby resetting display. In this exemplary embodiment, the reset voltage is applied to each cyan particle C and each red particle R. In this exemplary embodiment, the reset voltage is used to move the particle groups of all colors to the rear substrate 52. However, the reset voltage may be used to move the particle groups of all colors to the display substrate 50. When the particle groups of the same color move to the display substrate 50 or the rear substrate 52, for example, the reset voltage may be used to move all cyan particles C to the display substrate 50 and move all red particles R to the rear substrate 52. The order of Step S10 and Step S12 may be reversed.

Figure 4A:
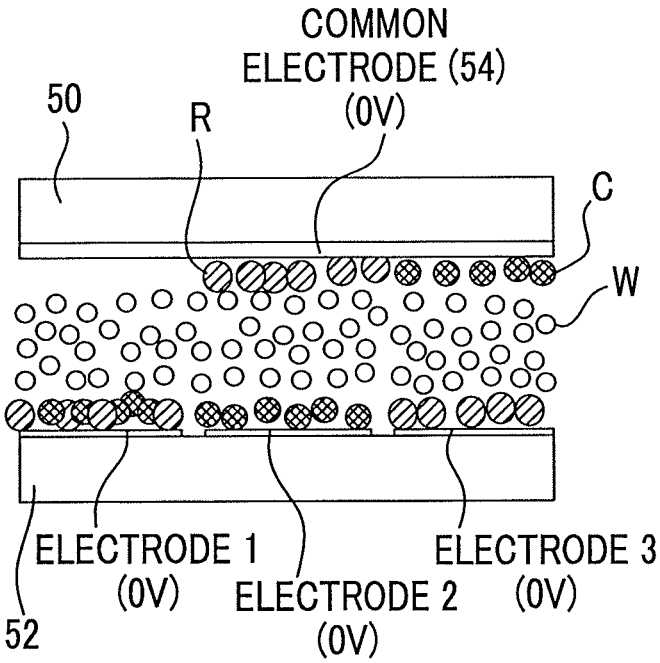
FIGS. 4A to 4C are schematic diagrams illustrating the movement of the migration particles when a voltage is applied in the first exemplary embodiment.
Figure 4B:
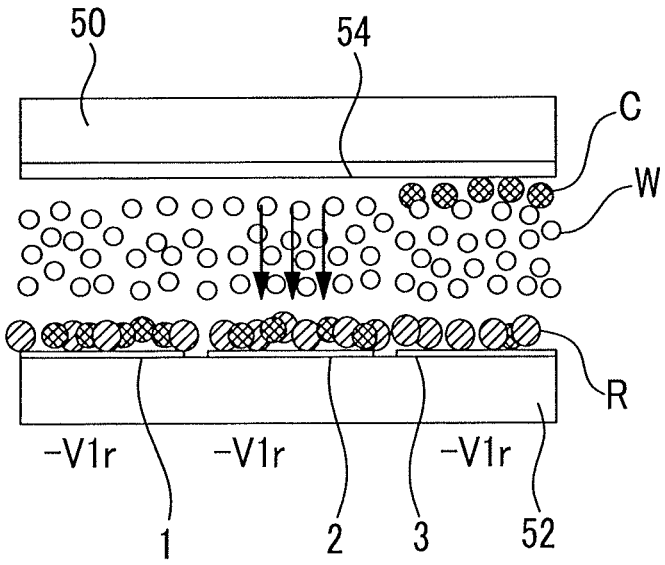
Figure 4C:
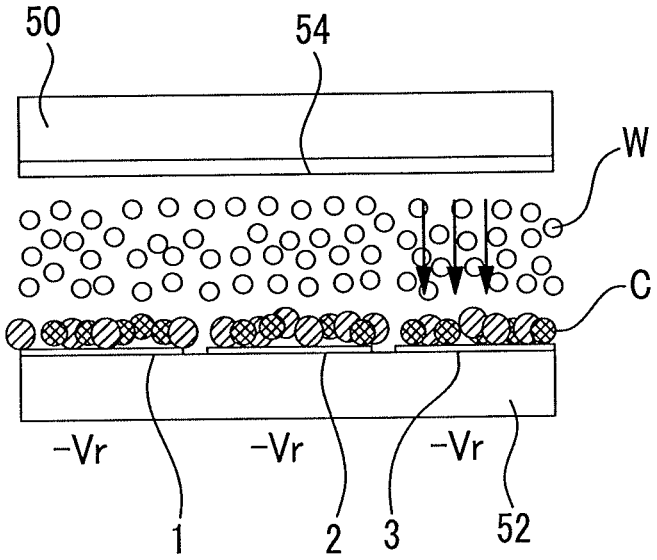

FIGS. 4A to 4C show an aspect of the movement of particles when the reset voltage is applied to each of the particle groups of different colors. Hereinafter, for simplicity of explanation, as shown in FIG. 4A, a case in which three electrodes 1 to 3 are provided as the rear-surface-side electrodes 56 in one cell will be described. FIG. 4A shows a state in which the previous image is displayed, in which white formed by white particles W is displayed on the display substrate 50 above the left electrode 1, red formed by the red particles R is displayed on the display substrate 50 above the central electrode 2, and cyan formed by the cyan particles C is displayed on the display substrate 50 above the right electrode 3. In addition, the common electrode serving as the display-side electrode 54 is connected to the ground and no voltage is applied to the electrodes 1 to 3.

Figure 5:
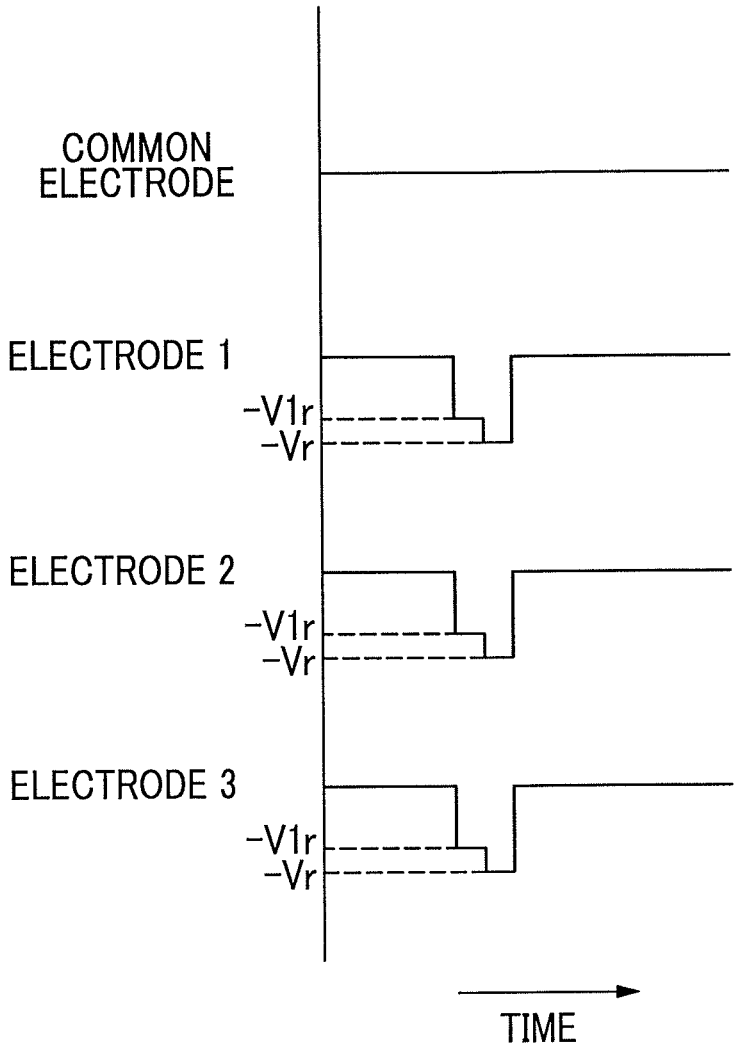
FIG. 5 is a diagram illustrating the waveform of an applied voltage in the first exemplary embodiment.

In this state, as shown in FIG. 4B and FIG. 5, a voltage −V1*r* that is equal to or lower than the threshold voltage −V1 of the red particle R and is higher than the movement start voltage −V2*a* of the cyan particle C is applied to the electrodes 1 to 3. That is, the voltage −V1*r* satisfying $|V1|\leq|V1r|<|V2a|$ is applied such that only all red particles R move. In this way, as shown in FIG. 4B, all red particles R which are arranged above the electrode 2 so as to be close to the display substrate 50 move to the rear substrate 52 and the cyan particles C which are arranged above the electrode 3 so as to be close to the display substrate 50 do not move, but remain on the display substrate 50. In this way, first, the display of red is reset.

Then, as shown in FIG. 4C and FIG. 5, a voltage −Vr that is equal to or lower than the threshold voltage −V2 of the cyan particle C is applied to the electrodes 1 to 3. That is, the voltage −Vr satisfying $|V2|<|Vr|$ is applied such that all cyan particles C moves to the rear substrate 52. In this way, as shown in FIG. 4C, all cyan particles C which are arranged above the electrode 3 so as to be close to the display substrate 50 move to the rear substrate 52. In this way, the display of cyan is reset. In FIG. 5, the voltage −Vr is applied immediately after the voltage −V1*r* is applied and the display of cyan is reset immediately after the display of red is reset. However, there may be an interval between the reset of red and the reset of cyan. That is, a period for which the voltage of the electrodes 1 to 3 is 0 V may be provided from the reset of red to the reset of cyan. This holds for other exemplary embodiments which will be described below.

Figure 3:
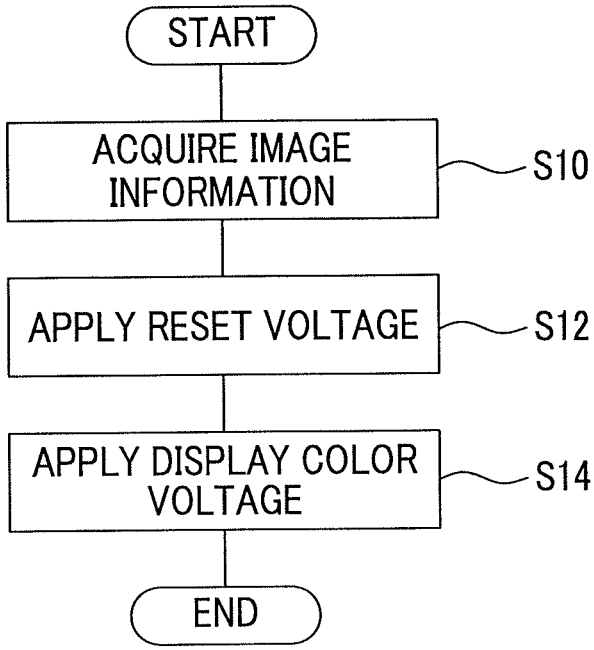
FIG. 3 is a flowchart illustrating a process performed by the control unit.

In Step S14 of FIG. 3, the CPU 40A determines a display color voltage to be applied to the rear-surface-side electrode 56 on the basis of the acquired image information and notifies the voltage applying unit 30 of the display color voltage. The voltage applying unit 30 applies the display color voltage notified by the control unit 40 to the rear-surface-side electrode 56.

The display color voltage corresponds to the gradation of the color to be displayed on the display medium 10. For example, when red gradation display is performed, the display color voltage is higher than the movement start voltage +V1*a* of the red particle R and is lower than the movement start voltage +V2*a* of the cyan particle C. The voltage value corresponds to the gradation (density) of red to be displayed. When cyan gradation display is performed, the display color voltage is higher than the movement start voltage +V2*a* of the cyan particle C. The voltage value corresponds to the gradation (density) of cyan to be displayed. However, since the red particle R also moves to the display substrate 50, a cyan display color voltage is applied and then a voltage for moving all red particles R to the rear substrate 52 is applied. The voltage value may be the same and gradation control may be performed by the pulse width. The gradation control may be performed by a combination of the voltage value and the pulse width.

When the gradation of a mixed color of red and cyan is displayed, for example, red gradation display is performed after cyan gradation display is performed as described above.

As such, in this exemplary embodiment, when the previously displayed image is reset, the particle groups of different colors are each moved to the rear substrate 52 and the display of each color is reset. Therefore, the non-uniform distribution of particles for each pixel due to the image displayed in the reset state is prevented, as compared to a case in which particle groups of all colors are moved to the rear substrate 52 at a time to reset display.

Figure 6:
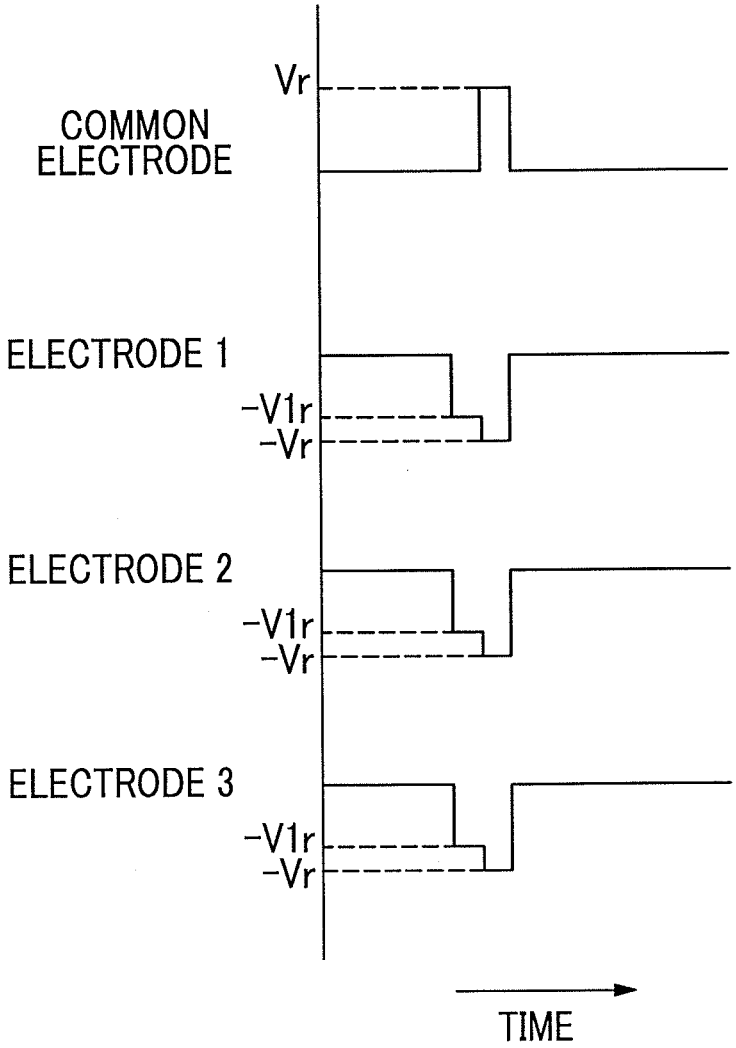
FIG. 6 is a diagram illustrating the waveform of the applied voltage in the first exemplary embodiment.

As shown in FIG. 6, when cyan is reset, a voltage with a polarity opposite to that of the voltage −Vr applied to the electrodes 1 to 3, for example, the voltage +Vr may be applied to the common electrode (display-side electrode 54). In this case, the intensity of the electric field generated between the substrates increases and the time required for reset is reduced, as compared to a case in which the common electrode is connected to the ground. As another method, a particle (in this exemplary embodiment, the red particle R) reset voltage lower than the movement start voltage is applied to start to move the particle R and a voltage for moving a particle (in this exemplary embodiment, the cyan particle C) with the second highest movement start voltage may start to apply before the red particle R reaches the opposite substrate. In this case, the voltage in the second half of the time when the red particle R moves increases and the time required to reset the red particle R is reduced. In addition, the time when the red particle R moves overlaps the time when the cyan particle C moves. In this way, the total time required for reset is reduced. These methods are effective in a case in which the particles with the same polarity and a low movement start voltage are reset first in the following other exemplary embodiments.

Second Exemplary Embodiment

Next, a second exemplary embodiment will be described. In the second exemplary embodiment, the same components as those in the first exemplary embodiment are denoted by the same reference numerals and the detailed description thereof will not be repeated.

In this exemplary embodiment, a case in which the display is reset for each particle group of different colors according to the image which is being displayed will be described. The device structure and the threshold characteristics of each particle are the same as those in the first exemplary embodiment and thus the description thereof will not be repeated.

Figure 31:
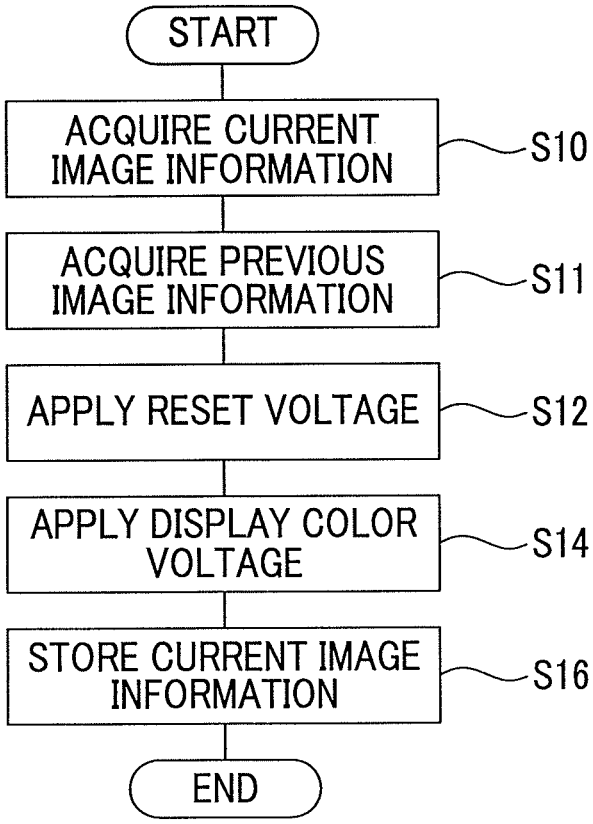
FIG. 31 is a flowchart illustrating a process performed by a control unit according to the second exemplary embodiment.

Next, a control operation performed by a CPU 40A of a control unit 40 will be described. As shown in FIG. 31, in Step S10, image information about the image to be displayed on a display medium 10 this time is acquired through, for example, an I/O 40E.

In Step S11, image information written in a writing step S14 in a previous display cycle, that is, image information about the image which is displayed immediately before reset is acquired. The image information written in the writing step S14 in the previous display cycle is stored in, for example, a storage unit (not shown) or a lookup table in advance.

Next, the application of a reset voltage in Step S12 will be described.

Figure 7A:
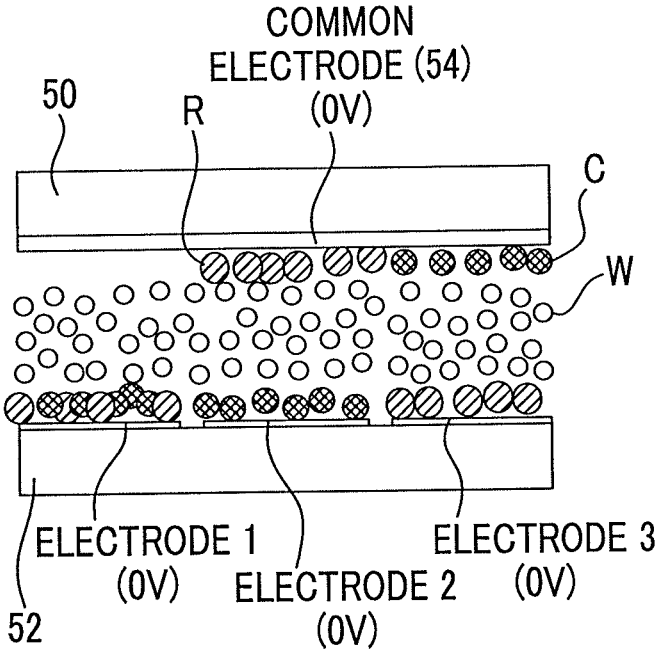
FIGS. 7A to 7C are schematic diagrams illustrating the movement of migration particles when a voltage is applied in a second exemplary embodiment.
Figure 7B:
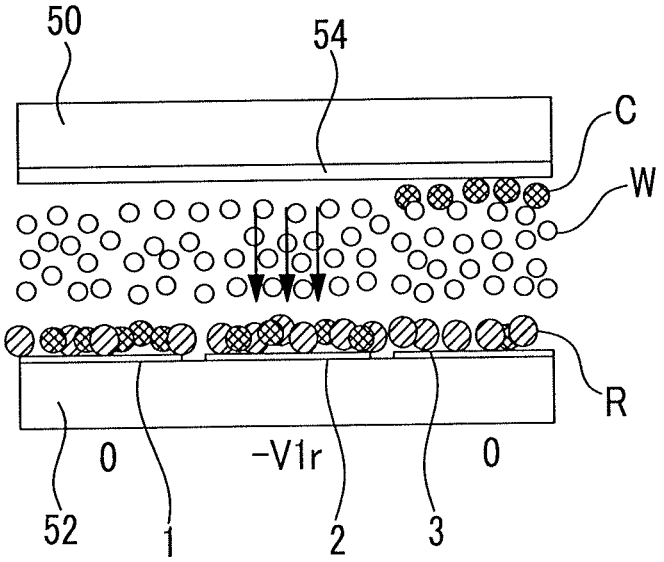
Figure 7C:
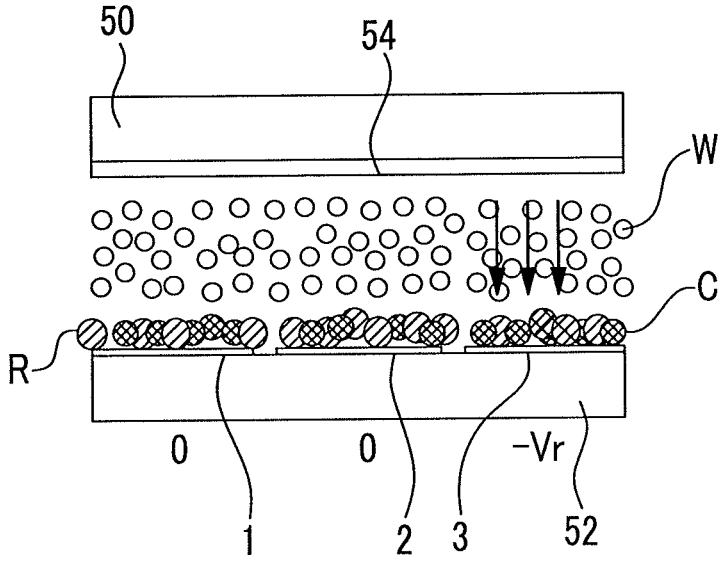

FIGS. 7A to 7C show an aspect of the movement of particles when the reset voltage is applied to each particle group of different colors according to the image which is being displayed. FIG. 7A shows a state in which the previous image is displayed and is the same as FIG. 4A.

Figure 8:
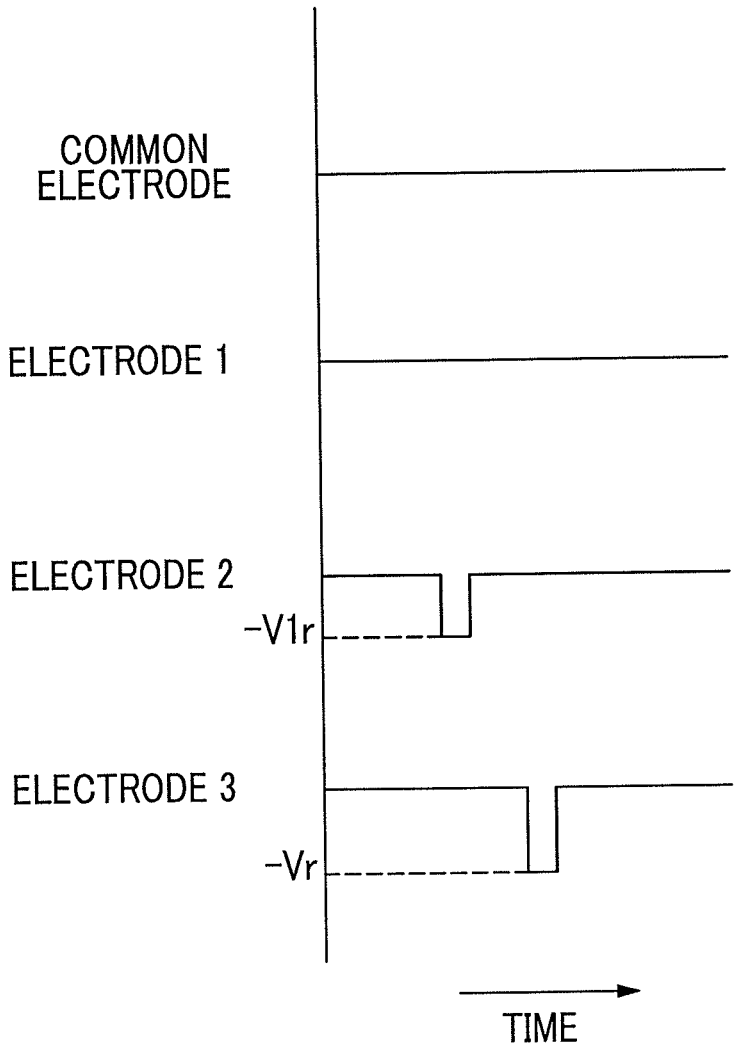
FIG. 8 is a diagram illustrating the waveform of an applied voltage in the second exemplary embodiment.

In this state, as shown in FIG. 7B and FIG. 8, a voltage −V1*r* that is equal to or lower than the threshold voltage −V1 of the red particle R and is higher than the movement start voltage −V2*a* of the cyan particle C is applied only to the electrode 2. That is, the voltage −V1*r* satisfying $|V1| \leq |V1r| < |V2a|$ is applied only to the electrode 2 such that the red particle R which is arranged above the electrode 2 so as to be close to the display substrate 50 moves. No voltage is applied to the electrodes 1 and 3 and the electrodes 1 and 3 are maintained at 0 V. In this way, as shown in FIG. 7B, all red particles R which are arranged above the electrode 2 so as to be close to the display substrate 50 move to the rear substrate 52, and particles of the pixels corresponding to the electrodes 1 and 3 do not move. In this way, first, the display of red is reset.

Then, as shown in FIG. 7C and FIG. 8, a voltage −Vr that is equal to or lower than the threshold voltage −V2 of the cyan particle C is applied only to the electrode 3. That is, the voltage −Vr satisfying $|V2| < |Vr|$ is applied only to the electrode 3 such that the cyan particle C which is arranged above the electrode 3 so as to be close to the display substrate 50 moves. No voltage is applied to the electrodes 1 and 2 and the electrodes 1 and 2 are maintained at 0 V. In this way, as shown in FIG. 7C, all cyan particles C above the electrode 3 move to the rear substrate 52. In this way, the display of cyan is reset.

As such, in this exemplary embodiment, when the previously displayed image is reset, each particle group of different colors is moved to the rear substrate 52 according to the image which is being displayed to reset the display of each color. For each of the particle groups of different colors, a voltage is applied only to the electrode corresponding to the image whose color is displayed and no voltage is applied to the electrode corresponding to the image whose color is not displayed. Therefore, the non-uniform distribution of particles for each pixel due to the image displayed in the reset state is prevented, as compared to a case in which display is reset regardless of the image which is being displayed.

Figure 9:
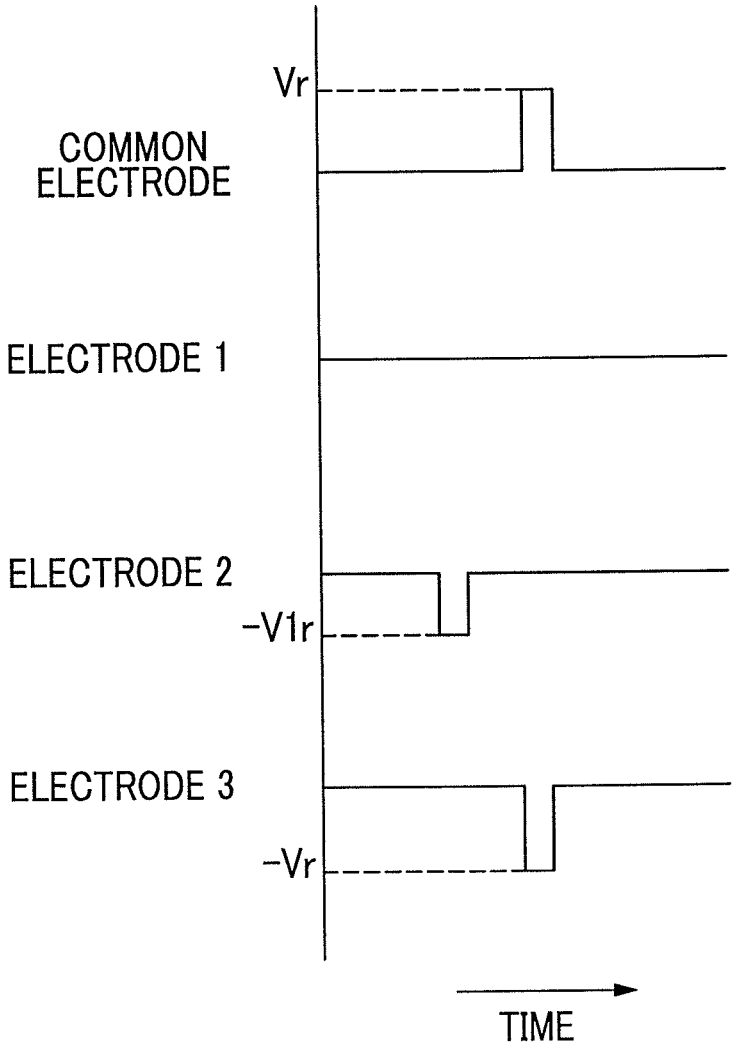
FIG. 9 is a diagram illustrating the waveform of the applied voltage in the second exemplary embodiment.

As shown in FIG. 9, when cyan is reset, a voltage with a polarity opposite to that of the voltage −Vr applied to the electrode 3, for example, a voltage +Vr may be applied to the common electrode (display-side electrode 54). In this case, the intensity of the electric field generated between the substrates increases and the time required for reset is reduced, as compared to a case in which the common electrode is connected to the ground.

Then, display is performed according to information about the image to be displayed in Step S14 and the image information is stored in, for example, a storage unit (not shown) or a lookup table in Step S16. The order of Steps S10, S11, and S12 may be changed in the range in which the relation in which Step S12 is performed after Step S11 is ensured. For example, the processing order of Steps S10, S11, and S12 may be S10→S11→S12, S11→S12→S10, or S11→S10→S12.

Third Exemplary Embodiment

Next, a third exemplary embodiment will be described. In the third exemplary embodiment, the same components as those in the first exemplary embodiment are denoted by the same reference numerals and the detailed description thereof will not be repeated.

In this exemplary embodiment, a case in which particle groups of each color move to the rear substrate 52 in an order opposite to the display order of each color when an image is displayed to reset the display of each color will be described. The device structure and the threshold characteristics of each particle are the same as those in the first exemplary embodiment and thus the description thereof will not be repeated.

For control performed by a CPU 40A of a control unit 40, the process in Steps S10 and S14 of FIG. 3 is the same as that in the first exemplary embodiment and the description thereof will not be repeated. The application of a reset voltage in Step S12 will be described.

Figure 10A:
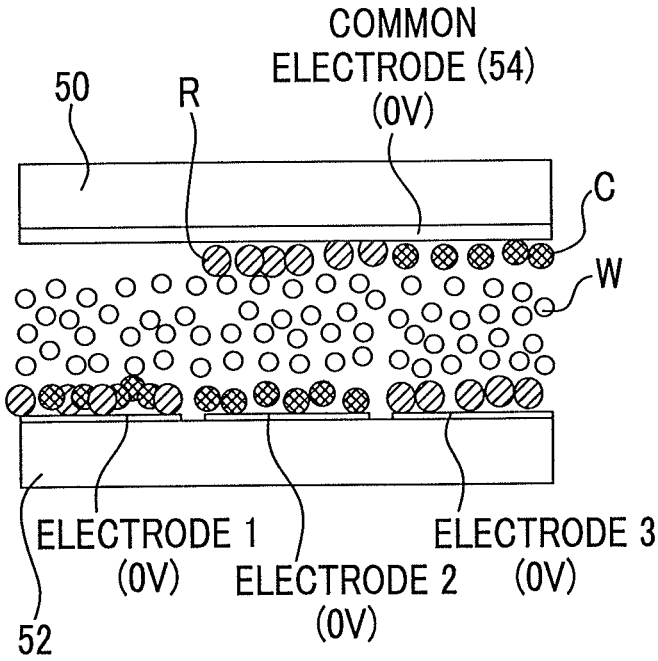
FIGS. 10A to 10D are schematic diagrams illustrating the movement of migration particles when a voltage is applied in a third exemplary embodiment.

FIGS. 10A to 10D show an aspect of the movement of particles when a reset voltage is applied such that particle groups of each color move to the rear substrate 52 in an order opposite to the display order of each color during the display of an image. FIG. 10A shows a state in which the previous image is displayed and is the same as FIG. 4A.

In the state shown in FIG. 10A, as described in the first exemplary embodiment, for example, after cyan gradation display is performed, red gradation display is performed.

In this exemplary embodiment, display is reset in an order opposite to the display order. That is, after the display of red is reset, the display of cyan is reset.

Figure 10B:
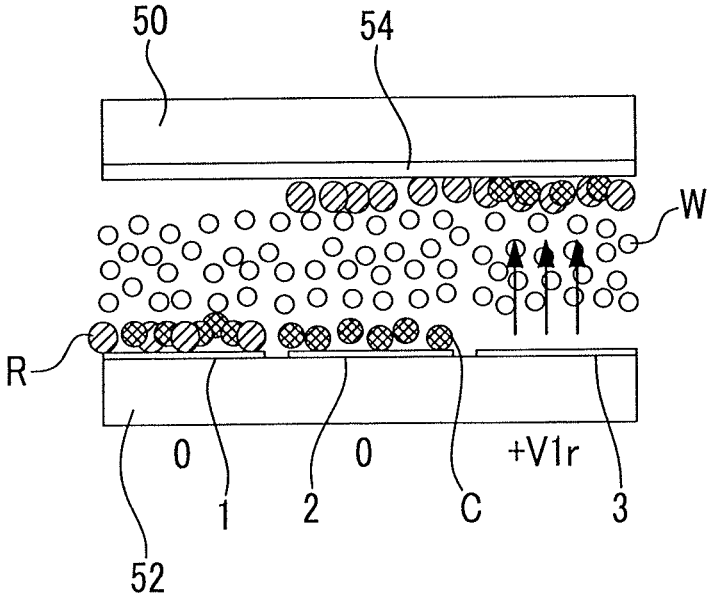
Figure 11:
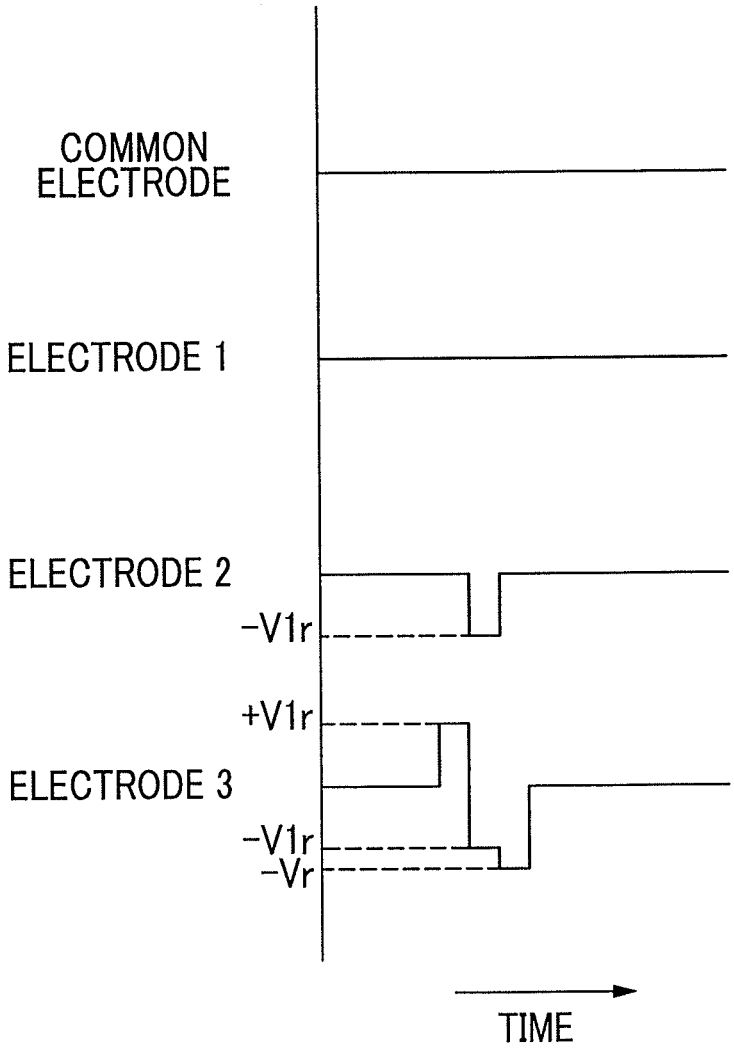
FIG. 11 is a diagram illustrating the waveform of an applied voltage in the third exemplary embodiment.

Then, in the state shown in FIG. 10A, as shown in FIG. 10B and FIG. 11, a voltage +V1*r* that is equal to or higher than the threshold voltage +V1 of a red particle R and is lower than the movement start voltage +V2*a* of a cyan particle C is applied only to an electrode 3. That is, the voltage +V1*r* satisfying $|V1| \leq |V1r| < |V2a|$ is applied only to the electrode 3 such that only the red particle R which is arranged above the electrode 3 so as to be close to the rear substrate 50 moves to the display substrate 50. No voltage is applied to electrodes 1 and 2 and the electrodes 1 and 2 are maintained at 0 V. In this way, as shown in FIG. 10B, all red particles R which are arranged above the electrode 3 so as to be close to the rear substrate 50 move to the display substrate 50.

Figure 10C:
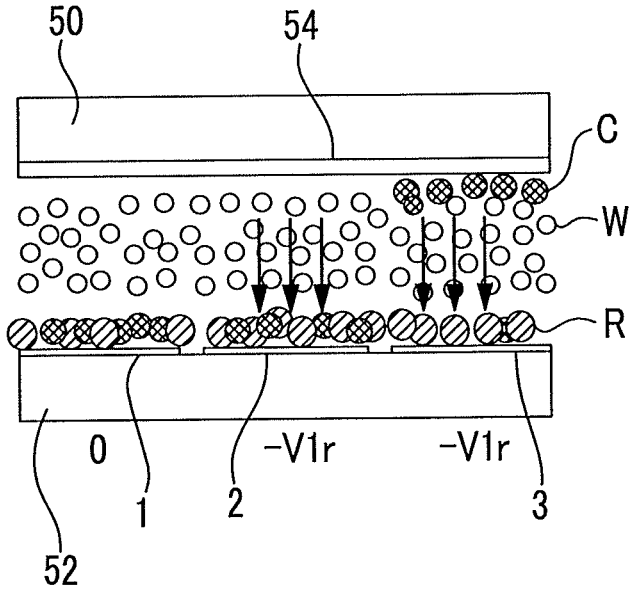

Then, as shown in FIG. 10C and FIG. 11, a voltage −Vr that is equal to or lower than the threshold voltage −V1 of the red particle R is applied to the electrodes 2 and 3. That is, the voltage −V1*r* satisfying the $|V1| \leq |V1r| < |V2a|$ is applied to the electrodes 2 and 3 such that the red particles R which are arrange above the electrodes 2 and 3 so as to be close to the display substrate 50 move to the rear substrate 52. No voltage is applied to the electrode 1 and the electrode 1 is maintained at 0 V. Then, as shown in FIG. 10C, all red particles R which are arranged above the electrodes 2 and 3 so as to be close to the display substrate 50 move to the rear substrate 52. In this way, the display of red is reset.

Figure 10D:
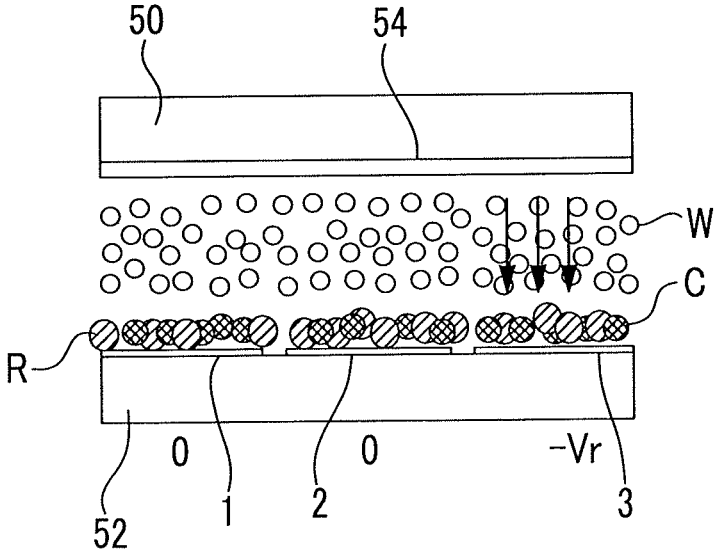

Then, as shown in FIG. 10D and FIG. 11, a voltage −Vr that is equal to or lower than the threshold voltage −V2 of the cyan particle C is applied only to the electrode 3. That is, the voltage −Vr satisfying $|V2| < |Vr|$ is applied only to the electrode 3 such that the cyan particles C which are arranged above the electrode 3 so as to be close to the display substrate 50 move. No voltage is applied to the electrodes 1 and 2 and the electrodes 1 and 2 are maintained at 0 V. Then, as shown in FIG. 10D, all cyan particles C which are arranged above the electrode 3 so as to be close to the display substrate 50 move to the rear substrate 52. In this way, the display of cyan is reset.

As such, in this exemplary embodiment, the reset voltage is applied such that the particle groups of each color move to the rear substrate 52 in an order opposite to the display order of each color when the image is displayed. In this way, the non-uniform distribution of particles for each pixel due to the image displayed in the reset state is prevented, as compared to a case in which display is reset regardless of the display order.

Fourth Exemplary Embodiment

Next, a fourth exemplary embodiment will be described. In the fourth exemplary embodiment, the same components as those in the first exemplary embodiment are denoted by the same reference numerals and the detailed description thereof will not be repeated.

In this exemplary embodiment, a case will be described in which a reverse image obtained by reversing the image which is being displayed for each color of the particle groups of different colors is sequentially displayed and then a reset voltage is applied such that all particle groups move to a rear substrate 52. The device structure and the threshold characteristics of each particle are the same as those in the first exemplary embodiment and thus the description thereof will not be repeated.

For control performed by a CPU 40A of a control unit 40, the process in Steps S10 and S14 in FIG. 3 is the same as that in the first exemplary embodiment and the description thereof will not be repeated. The application of a reset voltage in Step S12 will be described.

Figure 12A:
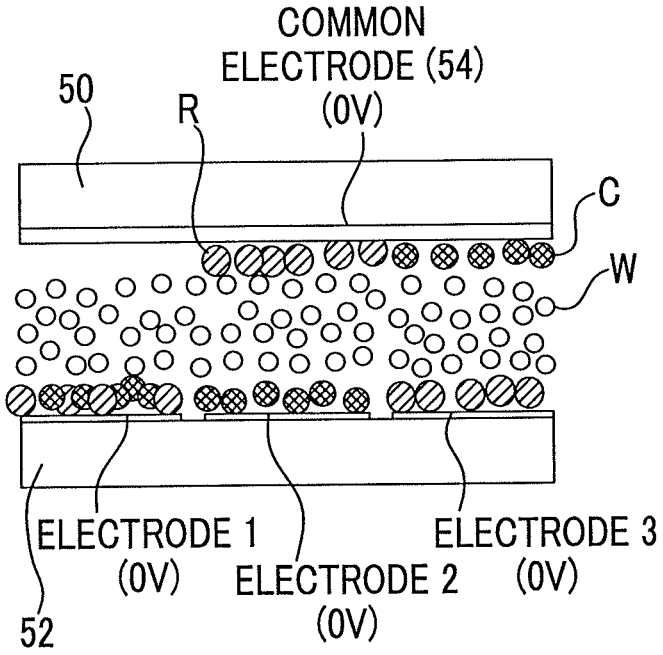
FIGS. 12A to 12D are schematic diagrams illustrating the movement of migration particles when a voltage is applied in a fourth exemplary embodiment.

FIGS. 12A to 12D show an aspect of the movement of particles when the reverse image obtained by reversing the image which is being displayed for each color of the particle groups of different colors is sequentially displayed and then the reset voltage is applied such that all particle groups move to the rear substrate 52. FIG. 12A shows a state in which the previous image is displayed and is the same as FIG. 4A.

As shown in FIG. 12A, in the image which is being displayed, red is displayed on the pixels corresponding to an electrode 2 by red particles R and cyan is displayed on the pixels corresponding to an electrode 3 by cyan particles C. Therefore, it is necessary to move the red particles R which are arranged above the electrodes 1 and 3 so as to be close to the display substrate 50 in order to write the reverse image of a red image which is being displayed and it is necessary to move the cyan particles C which are arranged above the electrodes 1 and 2 so as to be close to the display substrate 50 in order to write the reverse image of a cyan image which is being displayed.

Figure 12B:
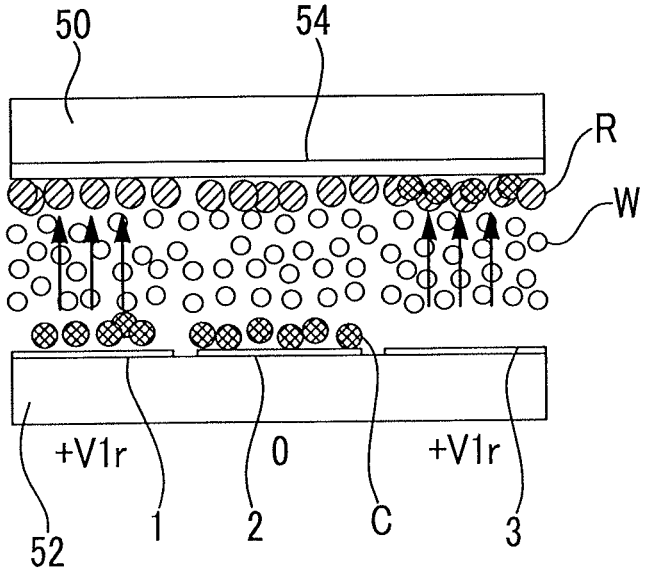
Figure 13:
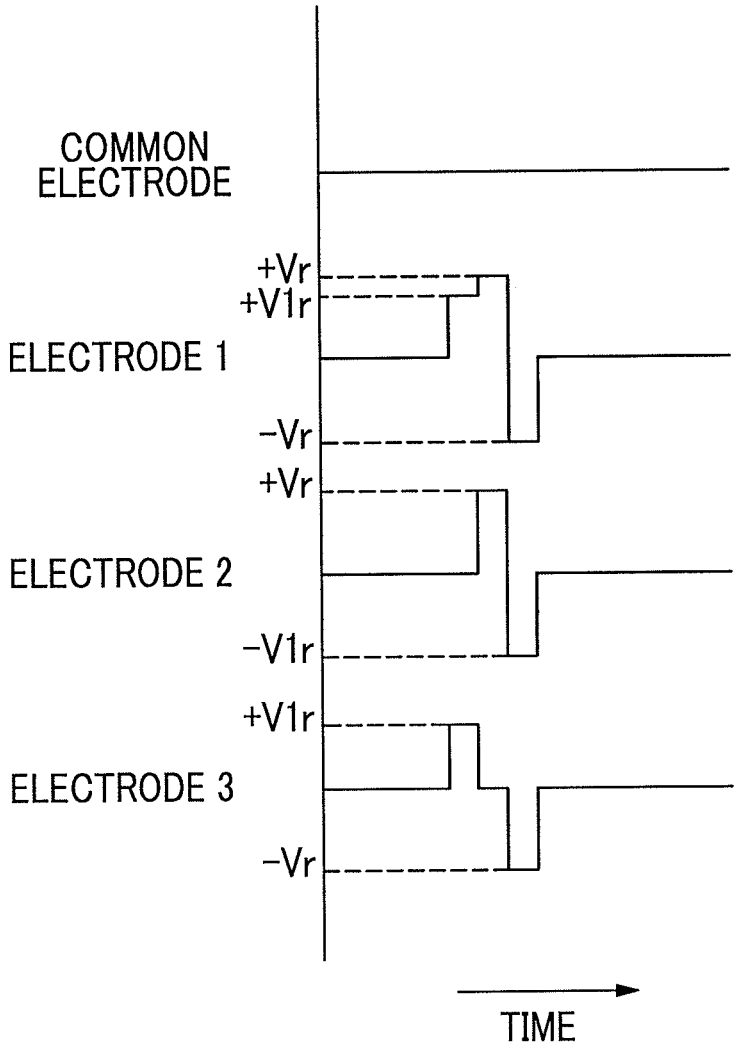
FIG. 13 is a diagram illustrating the waveform of an applied voltage in the fourth exemplary embodiment.

Therefore, in the state shown in FIG. 12A, as shown in FIG. 12B and FIG. 13, a voltage +V1*r* that is equal to or higher than the threshold voltage +V1 of the red particle R and is lower than the movement start voltage +V2*a* of the cyan particle C is applied to the electrodes 1 and 3. That is, the voltage +V1*r* satisfying |V1|≤|V1*r*|<|V2*a*| is applied to the electrodes 1 and 3 such that all red particles R above the electrodes 1 and 3 move to the display substrate 50. No voltage is applied to the electrode 2 and the electrode 2 is maintained at 0 V. That is, the reverse image of the red image which is being displayed is written. In this way, as shown in FIG. 12B, all red particles R above the electrodes 1 and 3 move to the display substrate 50.

Figure 12C:
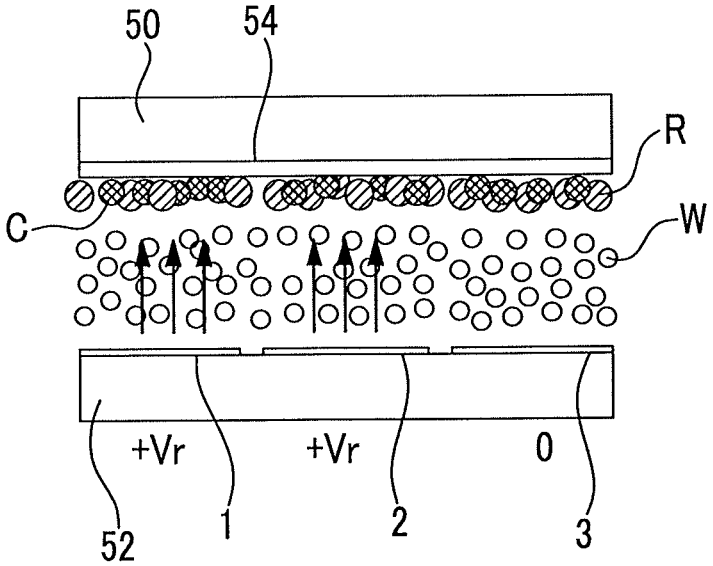

Then, as shown in FIG. 12C and FIG. 13, a voltage +Vr that is equal to or higher than the threshold voltage −V2 of the cyan particle C is applied to the electrodes 1 and 2. That is, the voltage +Vr satisfying |V2|<|Vr| is applied to the electrodes 1 and 2 such that all cyan particles C above the electrodes 1 and 2 move. No voltage is applied to the electrode 3 and the electrode 3 is maintained at 0 V. That is, the reverse image of the cyan image which is being displayed is written. In this way, as shown in FIG. 12C, all cyan particles C above the electrodes 1 and 2 move to the display substrate 50.

Figure 12D:
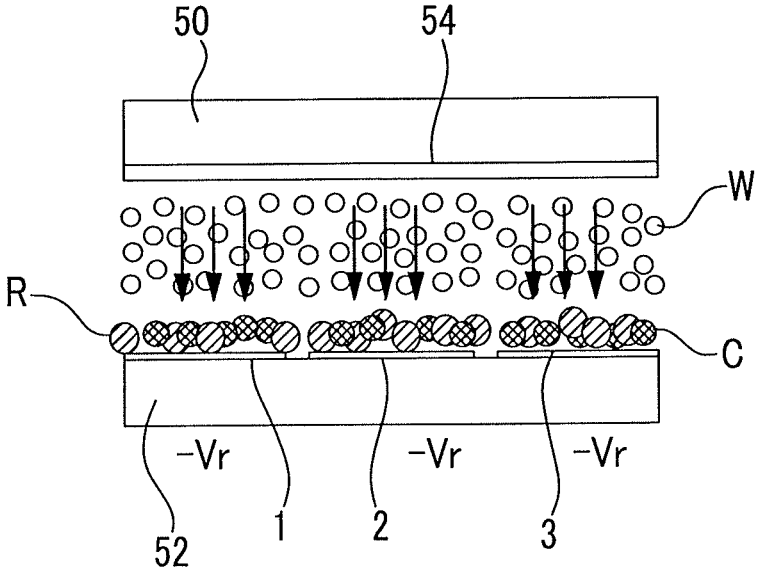

Then, as shown in FIG. 12D and FIG. 13, a voltage −Vr that is equal to or lower than the threshold voltage −V2 of the cyan particle C is applied to the electrodes 1 to 3. That is, the voltage −Vr satisfying |V2|<|Vr| is applied to the electrodes 1 and 2 such that all red particles R and all cyan particles C move to the display substrate 50. In this way, as shown in FIG. 12D, all red particles R and all cyan particles C close to the display substrate 50 move to the rear substrate 52.

As such, in this exemplary embodiment, after the reverse image obtained by reversing the image which is being displayed for each color of the particle groups of different colors is sequentially displayed, the reset voltage is applied such that all of the particle groups move to the rear substrate 52. In this way, the non-uniform distribution of particles for each pixel due to the image which is displayed in the reset state is prevented, as compared to a case in which display is reset regardless of the image which is being displayed.

Fifth Exemplary Embodiment

Next, a fifth exemplary embodiment will be described. In the fifth exemplary embodiment, the same components as those in the first exemplary embodiment are denoted by the same reference numerals and the detailed description thereof will not be repeated.

In this exemplary embodiment, a case will be described in which, after a reset voltage is applied to reset display, a voltage for moving all particle groups from a rear substrate 52 to a display substrate 50 and then moving all particle groups to the rear substrate 52, that is, a voltage for reciprocating all particle groups once from the rear substrate 52 after reset is applied. The device structure and the threshold characteristics of each particle are the same as those in the first exemplary embodiment and thus the description thereof will not be repeated.

For control performed by a CPU 40A of a control unit 40, the process in Steps S10 and S14 shown in FIG. 3 is the same as those in the first exemplary embodiment and the description thereof will not be repeated. The application of a reset voltage in Step S12 will be described.

Figure 14A:
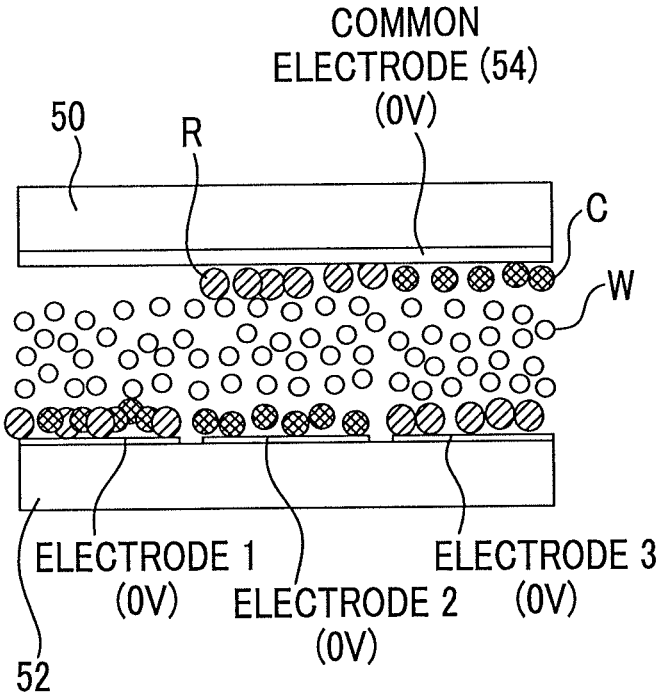
FIGS. 14A to 14E are schematic diagrams illustrating the movement of migration particles when a voltage is applied in a fifth exemplary embodiment.
Figure 14B:
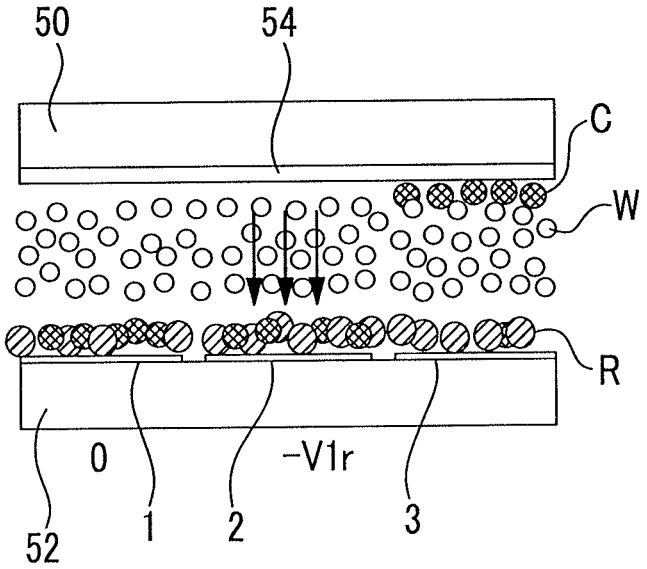
Figure 14C:
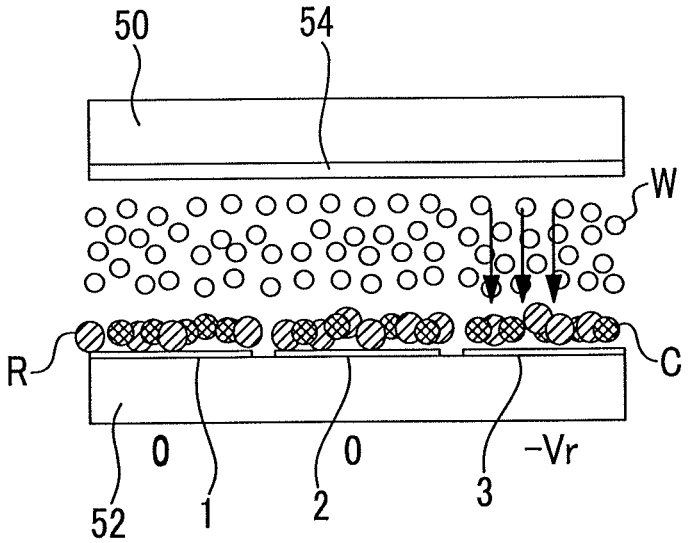

FIGS. 14A to 14E show an aspect of the movement of particles when all particle groups are reciprocated once from the rear substrate 52 after the image which is being displayed is reset. FIGS. 14A to 14C are the same as those in the second exemplary embodiment and the description thereof will not be repeated.

Figure 14D:
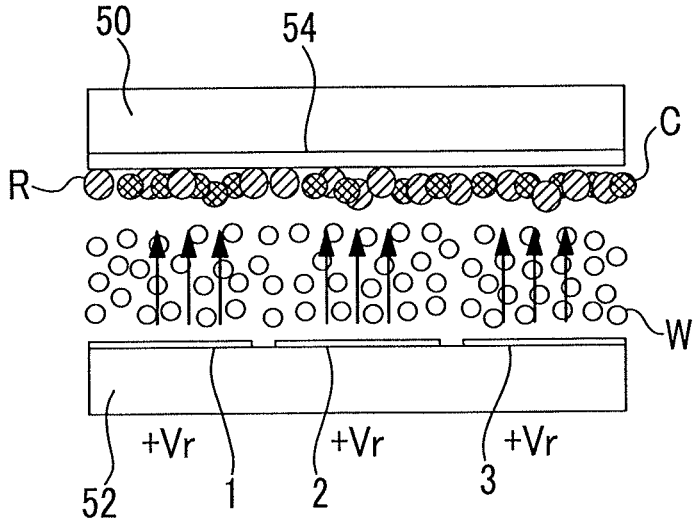
Figure 15:
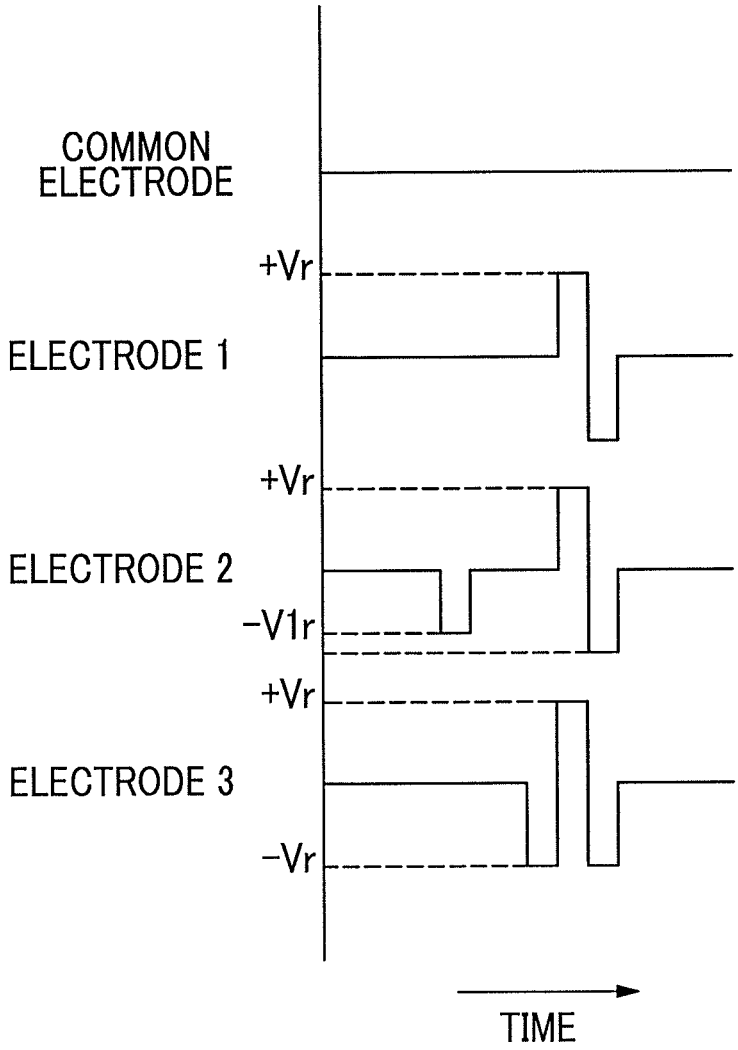
FIG. 15 is a diagram illustrating the waveform of an applied voltage in the fifth exemplary embodiment.

Similarly to the second exemplary embodiment, as shown in FIGS. 14A to 14C, after a reset voltage is applied to reset display, a voltage +Vr that is equal to or higher than the threshold voltage +V2 of a cyan particle C is applied to electrodes 1 to 3, as shown in FIG. 14D and FIG. 15. That is, the voltage +Vr satisfying |V2|≤|Vr| is applied to the electrodes 1 to 3 such that all cyan particles C and all red particles R above the electrodes 1 to 3 move to the display substrate 50. In this way, as shown in FIG. 14D, all cyan particles C and all red particles R above the electrodes 1 to 3 move to the display substrate 50.

Figure 14E:
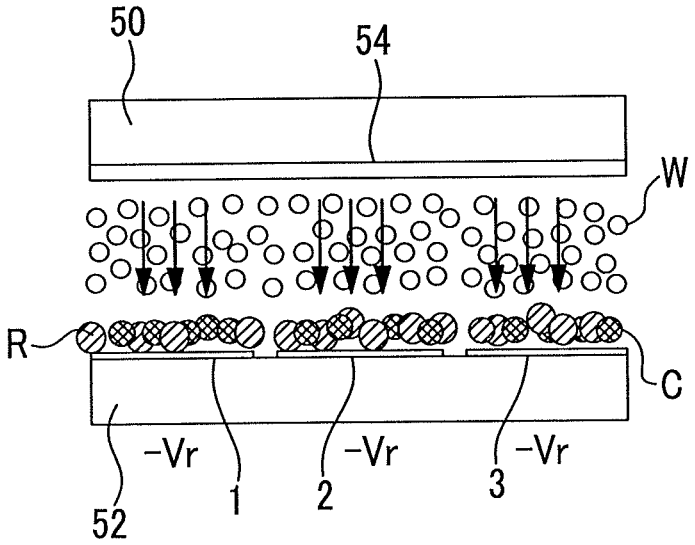

Then, as shown in FIG. 14E and FIG. 15, a voltage −Vr that is equal to or lower than the threshold voltage −V2 of the cyan particle C is applied to the electrodes 1 to 3. That is, the voltage −Vr satisfying |V2|<|Vr| is applied to the electrodes 1 to 3 such that all cyan particles C and all red particles R close to the display substrate 50 move to the rear substrate 52. In this way, as shown in FIG. 14E, all cyan particles C and all red particles R which are arranged close to the display substrate 50 move to the rear substrate 52.

As such, in this exemplary embodiment, after the displayed image is reset, all particle groups are reciprocated once. Therefore, the non-uniform distribution of particles for each pixel due to the image which is displayed in the reset state is presented.

In this exemplary embodiment, after the displayed image is reset by the method described in the fourth exemplary embodiment, all particle groups are reciprocated once. However, the reset method is not limited thereto. Reset methods according to the first to third exemplary embodiments and the following other exemplary embodiments may be used. After reset, all particle groups may be reciprocated two or more times.

Sixth Exemplary Embodiment

Next, a sixth exemplary embodiment will be described. In the sixth exemplary embodiment, the same components as those in the first exemplary embodiment are denoted by the same reference numerals and the detailed description thereof will not be repeated.

In this exemplary embodiment, a display medium 10 includes three kinds of particle groups, that is, a group of yellow particles Y, a group of magenta particles M, and a group of cyan particles C which have different colors and are charged with the same polarity, and a case will be described in which display is reset each particle group of different colors according to the image which is being displayed. The device structure is the same as that in the first exemplary embodiment and thus the description thereof will not be repeated.

Figure 16:
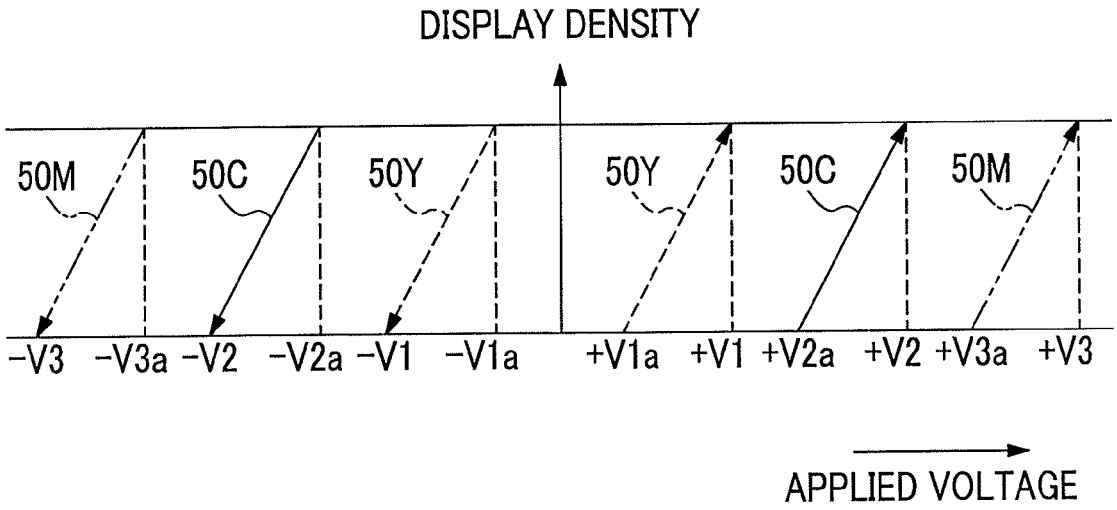
FIG. 16 is a diagram illustrating the voltage application characteristics of each migration particle in a sixth exemplary embodiment.

FIG. 16 shows the characteristics of voltages applied to move the yellow particles Y, the magenta particles M, and the cyan particles C which are all positively charged to a display substrate 50 and a rear substrate 52. In FIG. 16, the voltage-display density characteristics of the yellow particle Y are represented by characteristics 50Y, the voltage-display density characteristics of the magenta particle are represented by characteristics 50M, and the voltage-display density characteristics of the cyan particle C are represented by characteristics 50C. In addition, FIG. 16 shows the relationship between the voltage that is applied to a rear-surface-side electrode 56, with a display-side electrode 54 grounded (0 V), and display density by each particle group.

Since the characteristics 50C of the cyan particle C are the same as those in the first exemplary embodiment and the characteristics 50Y of the yellow particle Y are the same as the characteristics of the red particle R described in the first exemplary embodiment, the description thereof will not be repeated. Only the characteristics 50M of the magenta particle M will be described.

As shown in FIG. 16, a movement start voltage for generating an electric field which causes the magenta particle M close to the rear substrate 52 to start to move to the display substrate 50 is +V3*a*, and a movement start voltage for generating an electric field which causes the magenta particle M close to the display substrate 50 to start to move to the rear substrate 52 is −V3*a*. Therefore, when a voltage equal to or higher than +V3*a* is applied, the magenta particle M close to the rear substrate 52 moves to the display substrate 50. When a voltage equal to or lower than −V3*a* is applied, the magenta particle M close to the display substrate 50 moves to the rear substrate 52. In addition, a threshold voltage for generating an electric field which causes all magenta particles M close to the rear substrate 52 to move to the display substrate 50 is +V3, and a threshold voltage for generating an electric field which causes all magenta particles M close to the display substrate 50 to move to the rear substrate 52 is −V3.

For example, when the pulse width (voltage application time) of the voltage applied is the same, the number of magenta particles M moving from the rear substrate 52 to the display substrate 50 is controlled by changing the value of the voltage applied (voltage value modulation). For example, when the number of magenta particles M moving from the rear substrate 52 to the display substrate 50 is controlled, the pulse width of the voltage applied is the same and the voltage value is set to an arbitrary value equal to or higher than +V3, thereby moving the number of magenta particles M corresponding to the voltage value to the display substrate 50. In this way, the gradation display of the magenta particles M is controlled. This holds for the number of particles when the magenta particles M close to the display substrate 50 move to the rear substrate 52.

The value of the voltage applied may be the same and the pulse width may be changed to control the number of moving particles, thereby controlling gradation display (pulse width modulation). For example, during the control of the number of magenta particles M moving from the rear substrate 52 to the display substrate 50, when the value of the voltage applied is a predetermined voltage value equal to or higher than +V3*a*, the number of magenta particles M moving to the display substrate 50 increases as the pulse width increases. Therefore, when the voltage value is fixed and the pulse width has a value corresponding to gradation, the gradation display of the magenta particles M is controlled. In this exemplary embodiment, for example, a case in which the number of moving particles is controlled by voltage value modulation will be described.

For control performed by a CPU 40A of a control unit 40, the process in Step S10 shown in FIG. 3 is the same as that in the first exemplary embodiment and the description thereof will not be repeated. The process in Steps S12 and S14 will be described.

In Step S12, the CPU 40A instructs a voltage applying unit 30 to apply a reset voltage. The reset voltage is used to move all of the particles of the same color to the rear substrate 52, thereby resetting display. In this exemplary embodiment, the reset voltage is applied to each yellow particle Y, each magenta particle M, and each cyan particle C.

Figure 17A:
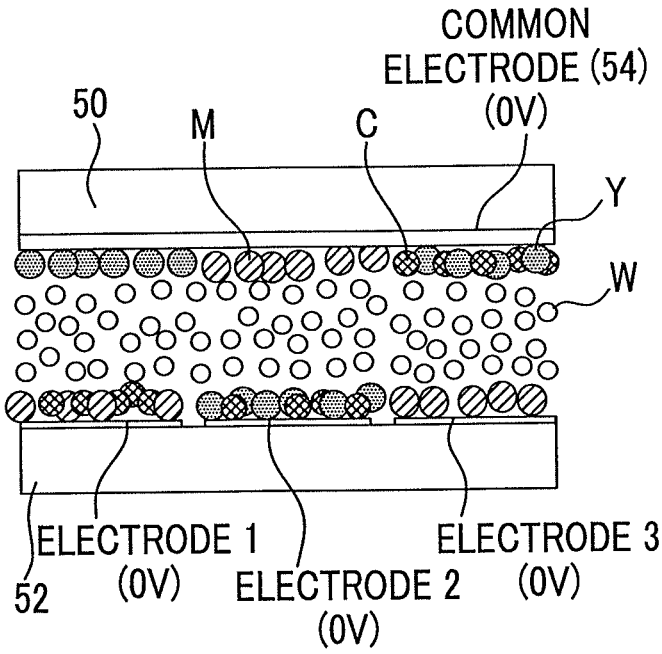
FIGS. 17A to 17D are schematic diagrams illustrating the movement of migration particles when a voltage is applied in the sixth exemplary embodiment.

FIGS. 17A to 17D show an aspect of the movement of particles when the reset voltage is applied to each particle group of different colors according to the image which is being displayed. FIG. 17A shows a state in which the previous image is displayed, in which yellow formed by the yellow particles Y is displayed on the display substrate 50 above the left electrode 1, magenta formed by the magenta particles M is displayed on the display substrate 50 above the central electrode 2, and green, which is a mixed color formed by the cyan particles C and the yellow particles Y, is displayed on the display substrate 50 above the right electrode 3. In addition, the common electrode serving as the display-side electrode 54 is connected to the ground and no voltage is applied to the electrodes 1 to 3.

Figure 17B:
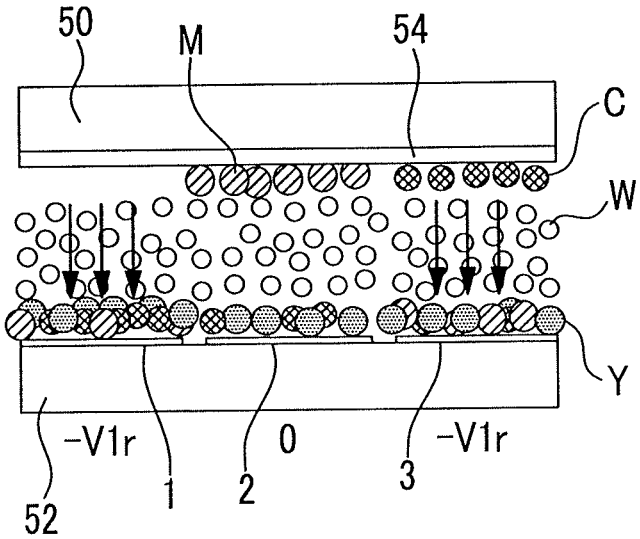
Figure 18:
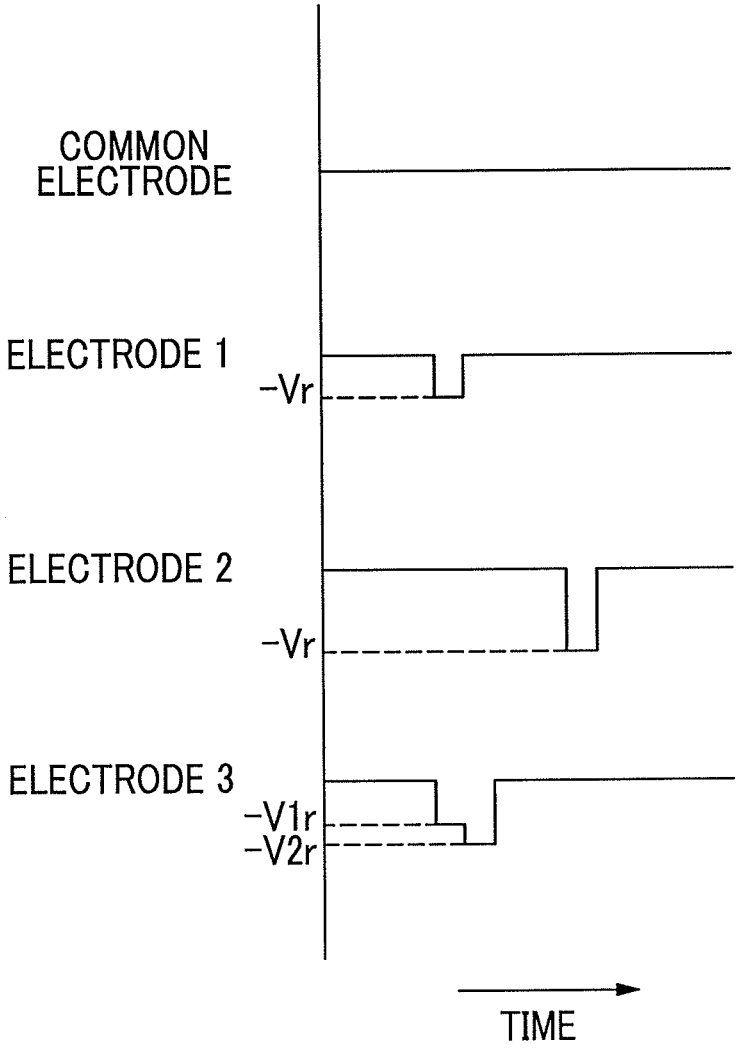
FIG. 18 is a diagram illustrating the waveform of an applied voltage in the sixth exemplary embodiment.

In this state, as shown in FIG. 17B and FIG. 18, a voltage −V1*r* that is equal to or lower than the threshold voltage −V1 of the yellow particle Y and is higher than the movement start voltage −V2*a* of the cyan particle C is applied to the electrodes 1 and 3. That is, the voltage −V1*r* satisfying $|V1| \leq |V1r| < |V2a|$ is applied to the electrodes 1 and 3 such that the yellow particles Y which are arranged above the electrodes 1 and 3 so as to be close to the display substrate 50 move to the rear substrate 52. No voltage is applied to the electrode 2 and the electrode 2 is maintained at 0 V. In this way, as shown in FIG. 17B, all yellow particles Y which are arranged above the electrodes 1 and 3 so as to be close to the display substrate 50 move to the rear substrate 52. Therefore, first, the display of yellow is reset.

Figure 17C:
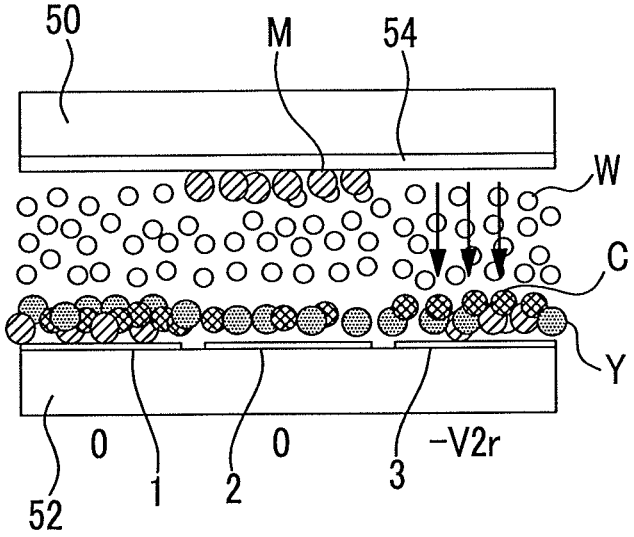

Then, as shown in FIG. 17C and FIG. 18, a voltage −V2*r* that is equal to or lower than the threshold voltage −V2 of the cyan particle C is applied only to the electrode 3. That is, the voltage −V2*r* satisfying $|V2| < |V2r|$ is applied only to the electrode 3 such that all cyan particles C above the electrode 3 move to the rear substrate 52. No voltage is applied to the electrodes 1 and 2 and the electrodes 1 and 2 are maintained at 0 V. In this way, as shown in FIG. 17C, all cyan particles C which are arranged above the electrode 3 so as to be close to the display substrate 50 move to the rear substrate 52. Therefore, the display of cyan is reset.

Figure 17D:
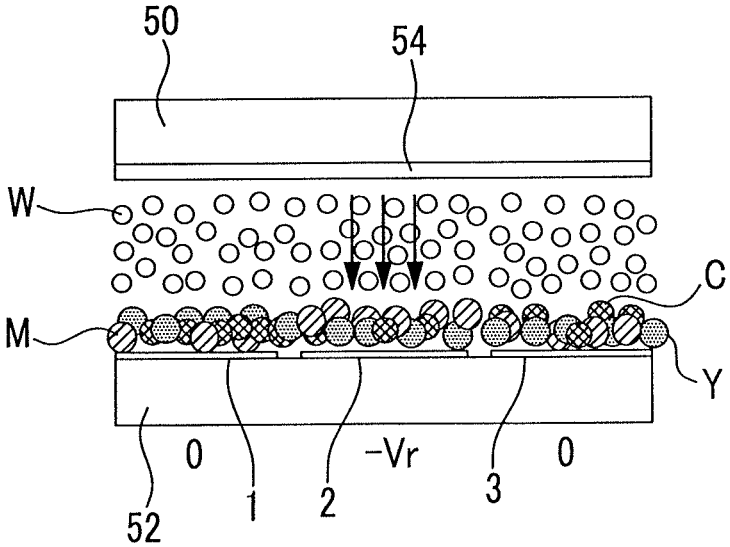

Then, as shown in FIG. 17D and FIG. 18, a voltage −Vr that is equal to or lower than the threshold voltage −V3 of the magenta particle M is applied only to the electrode 2. That is, the voltage −Vr satisfying $|V31| < |Vr|$ is applied only to the electrode 2 such that all magenta particles M which are arranged above the electrode 2 so as to be close to the display substrate 50 move to the rear substrate 52. No voltage is applied to the electrodes 1 and 3 and the electrodes 1 and 3 are maintained at 0 V. In this way, as shown in FIG. 17D, all magenta particles M which are arranged above the electrode 2 so as to be close to the display substrate 50 move to the rear substrate 52. Therefore, the display of magenta is reset.

In Step S14 of FIG. 3, the CPU 40A determines a display color voltage to be applied to the rear-surface-side electrode 56 on the basis of the acquired image information and notifies the voltage applying unit 30 of the display color voltage. The voltage applying unit 30 applies the display color voltage notified by the control unit 40 to the rear-surface-side electrode 56.

Next, for example, the flow of the application of the voltage when the state is changed from the reset state shown in FIG. 17D to the image display state shown in FIG. 17A will be described with reference to FIGS. 19A to 19E.

Figure 19A:
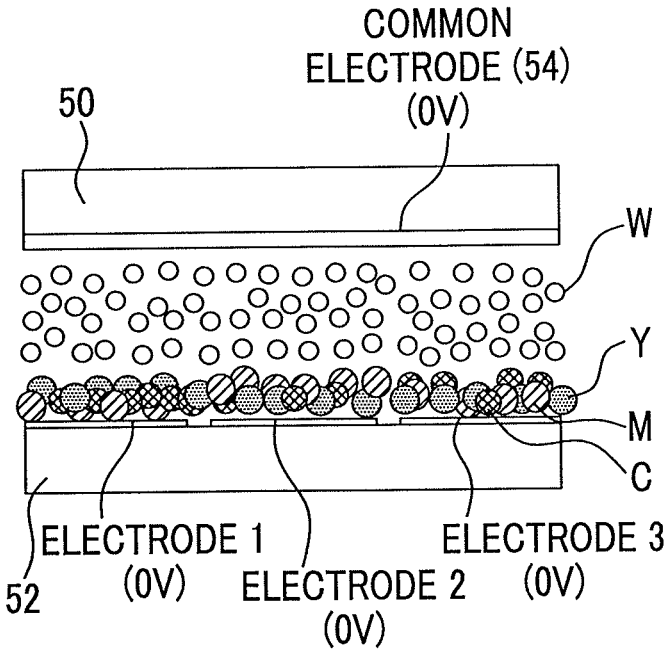
FIGS. 19A to 19E are schematic diagrams illustrating the movement of migration particles when a voltage is applied in the sixth exemplary embodiment.
Figure 19B:
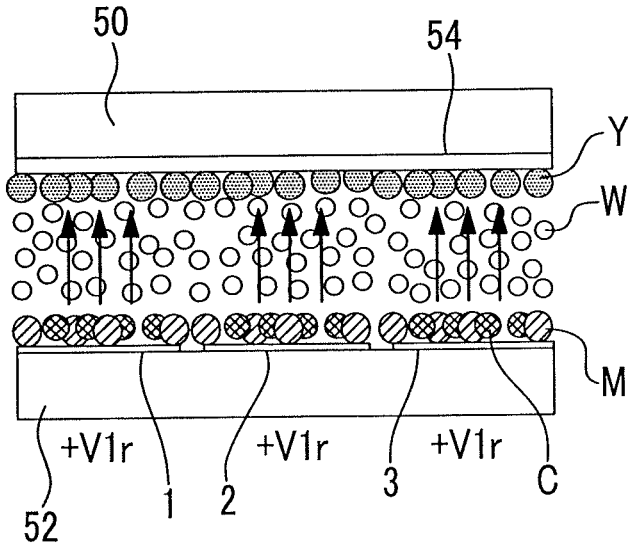
Figure 20:
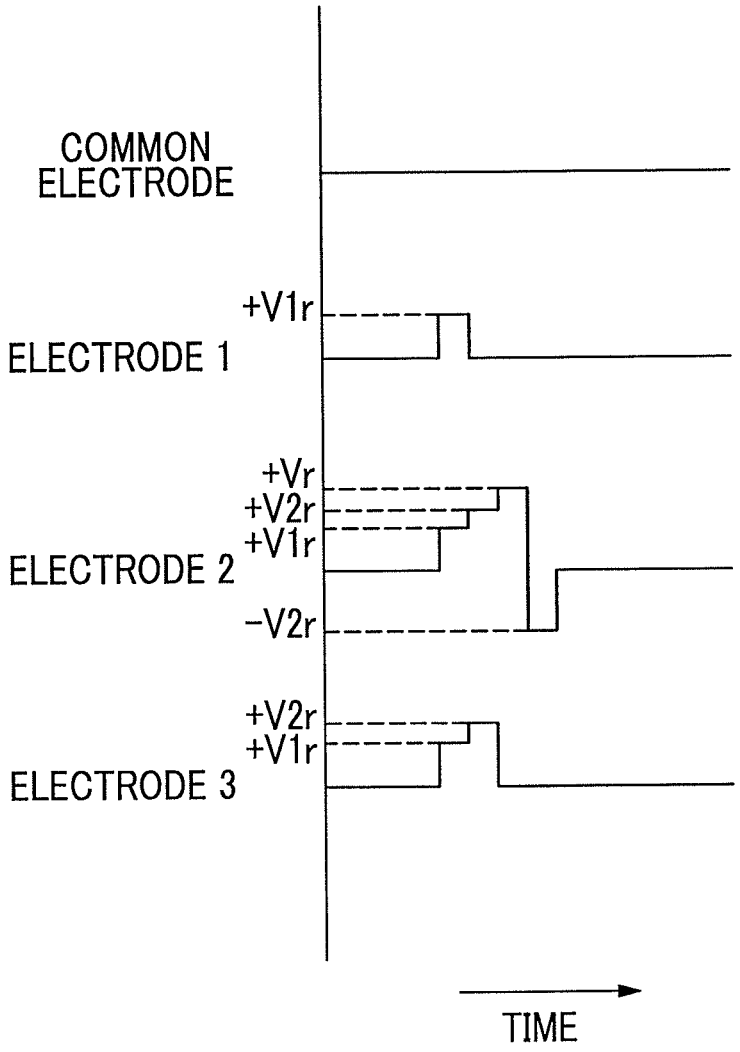
FIG. 20 is a diagram illustrating the waveform of the applied voltage in the sixth exemplary embodiment.

In the reset state in which all particles move to the rear substrate 52 as shown in FIG. 19A, a voltage +V1*r* that is equal to or higher than the threshold voltage +V1 of the yellow particle Y and is lower than the movement start voltage +V2*a* of the cyan particle C is applied to the electrodes 1 to 3, as shown in FIG. 19B and FIG. 20. That is, the voltage +V1*r* satisfying $|V1| \leq |V1r| < |V2a|$ is applied to the electrodes 1 to 3 such that the yellow particles Y which are arranged above the electrodes 1 to 3 so as to be close to the rear substrate 52 move to the display substrate 50. In this way, as shown in FIG. 19B, all yellow particles Y above the electrodes 1 to 3 move to the display substrate 50.

Figure 19C:
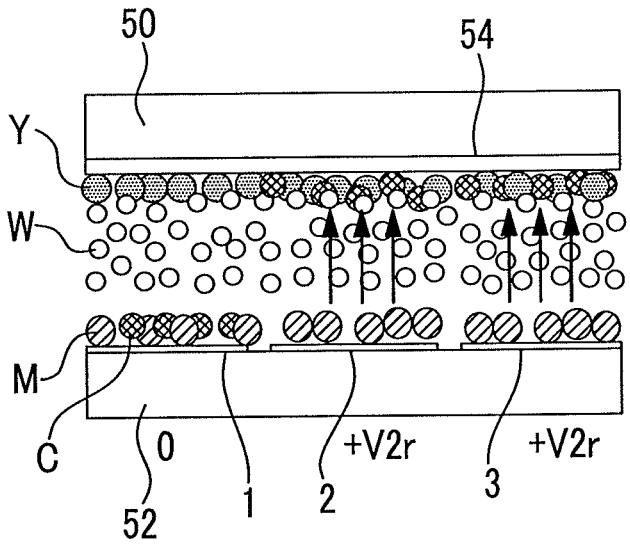

Then, as shown in FIG. 19C and FIG. 20, a voltage +V2*r* that is equal to or higher than the threshold voltage −V2 of the cyan particle C and is lower than the movement start voltage +V3*a* of the magenta particle M is applied to the electrodes 2 and 3. That is, the voltage +V2*r* satisfying |V2|≤|V2*r*|<|V3*a*| is applied to the electrodes 2 and 3 such that the cyan particles C which are arranged above the electrodes 2 and 3 so as to be close to the rear substrate 52 move to the display substrate 50. In this way, as shown in FIG. 19C, all cyan particles C above the electrodes 2 and 3 move to the display substrate 50.

Figure 19D:
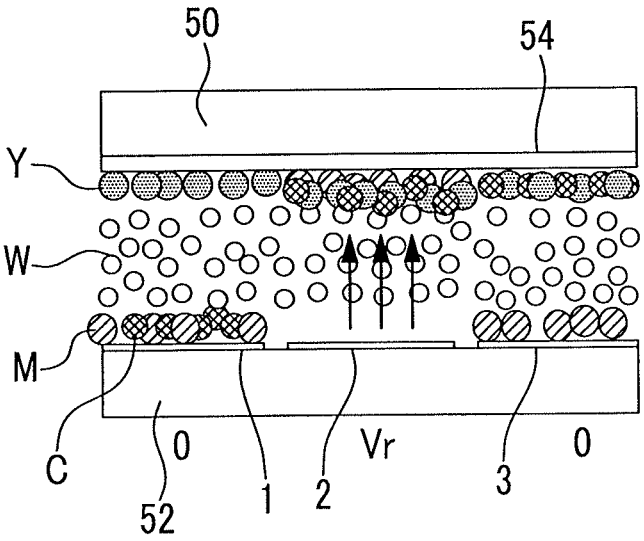

Then, as shown in FIG. 19D and FIG. 20, a voltage +Vr that is equal to or higher than the threshold voltage +V3 of the magenta particle M is applied only to the electrode 2. That is, the voltage +Vr satisfying |V3|<|Vr| is applied only to the electrode 2 such that all magenta particles M which are arranged above the electrode 2 so as to be close to the rear substrate 52 move to the display substrate 50. No voltage is applied to the electrodes 1 and 3 and the electrodes 1 and 3 are maintained at 0 V. In this way, all magenta particles M which are arranged above the electrode 2 so as to be close to the rear substrate 52 move to the display substrate 50, as shown in FIG. 19D.

Figure 19E:
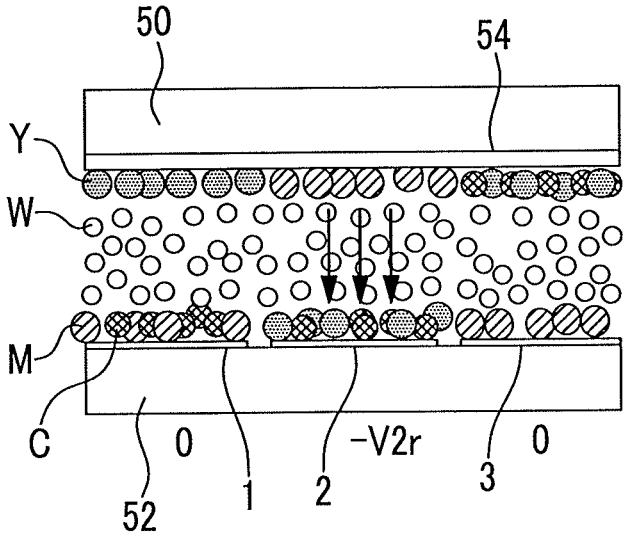

Then, as shown in FIG. 19E and FIG. 20, the voltage −V2*r* that is equal to or lower than the threshold voltage −V2 of the cyan particle C and is higher than the movement start voltage −V3*a* of the magenta particle M is applied only to the electrode 2. That is, the voltage −V2*r* satisfying |V2|≤|V2*r*|<|V3*a*| is applied to the electrodes 2 and 3 such that the cyan particles C and the yellow particles Y which are arranged above the electrode 2 so as to be close to the display substrate 50 move to the rear substrate 52. In this way, as shown in FIG. 19E, the cyan particles C and the yellow particles Y which are arranged above the electrode 2 so as to be close to the display substrate 50 move to the rear substrate 52 and only the magenta particles M remain above the electrode 2 so as to be close to the display substrate 50. When black is displayed, the yellow particles Y, the cyan particles C, and the magenta particles M all move to the display substrate 50 to display black which is a tertiary color.

As such, in this exemplary embodiment, the particles move to the display substrate 50 in ascending order of the threshold voltage according to the image to be displayed, thereby resetting display. Therefore, the non-uniform distribution of particles for each pixel due to the image which is displayed in the reset state is prevented, as compared to a case in which display is reset regardless of the threshold voltage.

Seventh Exemplary Embodiment

Next, a seventh exemplary embodiment will be described. In the seventh exemplary embodiment, the same components as those in the sixth exemplary embodiment are denoted by the same reference numerals and the detailed description thereof will not be repeated.

This exemplary embodiment differs from the sixth exemplary embodiment in that the cyan particle C is negatively charged. In this exemplary embodiment, a case in which display is reset for each of particle groups of different colors in ascending order of the threshold voltage will be described. The device structure is the same as that in the first exemplary embodiment and thus the description thereof will not be repeated.

Figure 21:
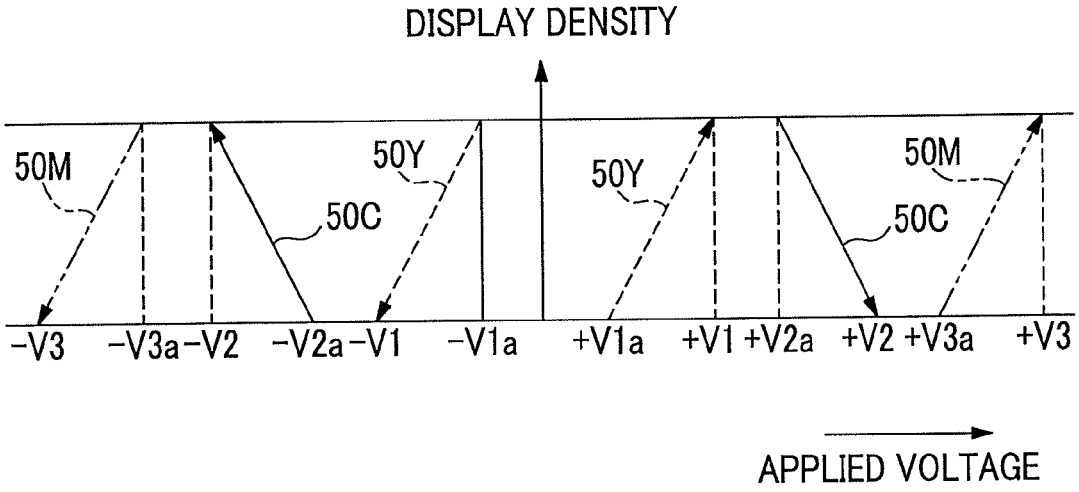
FIG. 21 is a diagram illustrating the voltage application characteristics of each migration particle in a seventh exemplary embodiment.

FIG. 21 shows the characteristics of voltages applied to move positively-charged yellow particles Y, positively-charged magenta particles M, and negatively-charged cyan particles C to a display substrate 50 and a rear substrate 52. The characteristics 50Y of the yellow particle Y and the characteristics 50M of the magenta particle M are the same as those in the sixth exemplary embodiment and thus the description thereof will not be repeated. Only the characteristics 50C of the cyan particle C will be described.

As shown in FIG. 21, a movement start voltage for generating an electric field which causes the cyan particles C close to the rear substrate 52 to start to move to the display substrate 50 is −V2*a*, and a movement start voltage for generating an electric field which causes the magenta particle M close to the display substrate 50 to start to move to the rear substrate 52 is +V2*a*. Therefore, when a voltage equal to or lower than −V2*a* is applied, the cyan particles C close to the rear substrate 52 move to the display substrate 50. When a voltage equal to or higher than +V2*a* is applied, the cyan particles C close to the display substrate 50 move to the rear substrate 52. In addition, a threshold voltage for generating an electric field which causes all cyan particles C close to the rear substrate 52 to move to the display substrate 50 is −V2, and a threshold voltage for generating an electric field which causes all cyan particles C close to the display substrate 50 to move to the rear substrate 52 is +V2.

For control performed by a CPU 40A of a control unit 40, the process in Step S10 shown in FIG. 3 is the same as that in the sixth exemplary embodiment and thus the description thereof will not be repeated. The process in Steps S12 and S14 will be described.

In Step S12, a reset voltage is applied to each of the particle groups of different colors in ascending order of the threshold voltage.

Figure 22A:
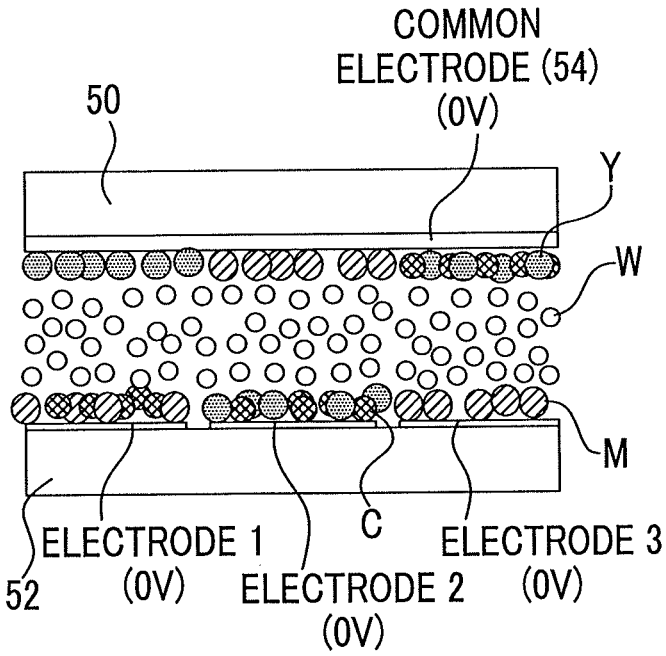
FIGS. 22A to 22F are schematic diagrams illustrating the movement of migration particles when a voltage is applied in the seventh exemplary embodiment.

FIGS. 22A to 22F show an aspect of the movement of particles when the reset voltage is applied to each of the particle groups of different colors in ascending order of the threshold voltage. FIG. 22A shows a state in which the previous image is displayed and is the same as FIG. 17A.

Figure 22B:
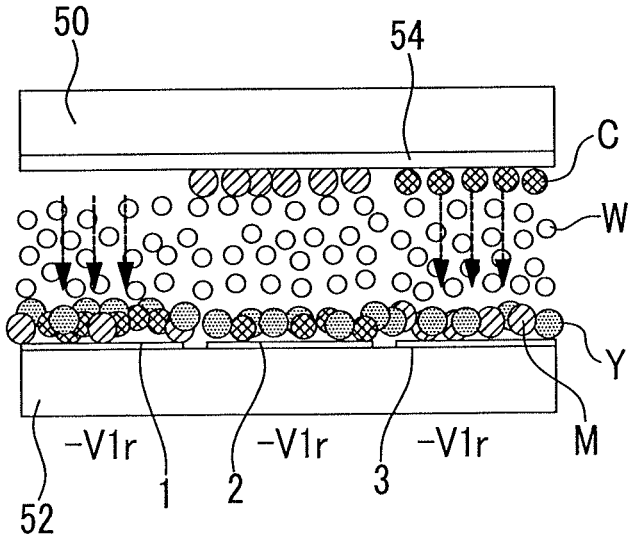

In this state, as shown in FIG. 22B, a voltage −V1*r* that is equal to or lower than the threshold voltage −V1 of the yellow particle Y and is higher than the movement start voltage −V2*a* of the cyan particle C is applied to electrodes 1 to 3. That is, the voltage −V1*r* satisfying |V1|≤|V1*r*|<|V2*a*| is applied to the electrodes 1 to 3 such that the yellow particles Y which are arranged above the electrodes 1 to 3 so as to be close to the display substrate 50 move to the rear substrate 52. In this way, as shown in FIG. 22B, all yellow particles Y which are arranged above the electrodes 1 to 3 so as to be close to the display substrate 50 move to the rear substrate 52 and display is reset. As shown in FIG. 22A, since there is no yellow particle Y which is arranged above the electrode 2 so as to be close to the display substrate 50, in practice, only the yellow particles Y which are arranged above the electrodes 1 and 3 so as to be close to the display substrate 50 move to the rear substrate 52.

Figure 22C:
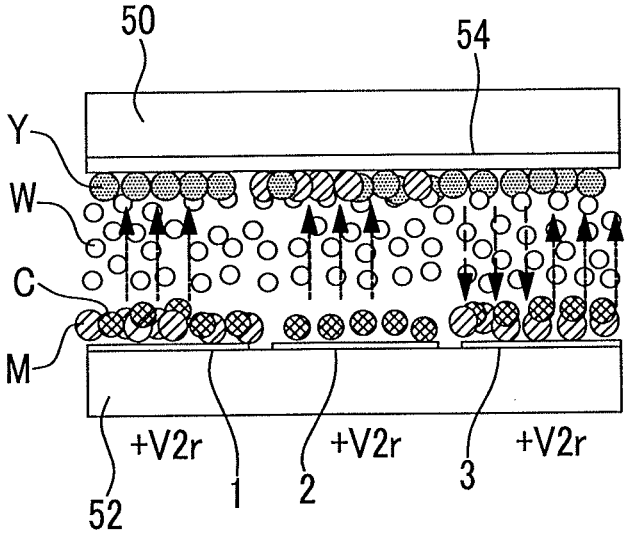

Then, as shown in FIG. 22C, a voltage +V2*r* that is equal to or higher than the threshold voltage +V2 of the cyan particle C and is lower than the movement start voltage +V3*a* of the magenta particle M is applied to the electrodes 1 to 3. That is, the voltage +V2*r* satisfying |V2|≤|V2*r*|<|V3*a*| is applied to the electrodes 1 to 3 such that the cyan particles C which are arranged above the electrodes 1 to 3 so as to be closer to the display substrate 50 move to the rear substrate 52. In this way, as shown in FIG. 22C, all cyan particles C which are arranged above the electrodes 1 to 3 so as to be close to the display substrate 50 move to the rear substrate 52. As shown in FIG. 22B, since there is no cyan particle C which is arranged above the electrodes 1 and 2 so as to be close to the display substrate 50, in practice, the cyan particles C which are arranged above the electrode 3 so as to be close to the display substrate 50 move the rear substrate 52 and display is reset. With the reset of the display, the yellow particles Y which are arranged above the electrodes 1 to 3 so as to be close to the rear substrate 52 move to the display substrate 50.

Figure 22D:
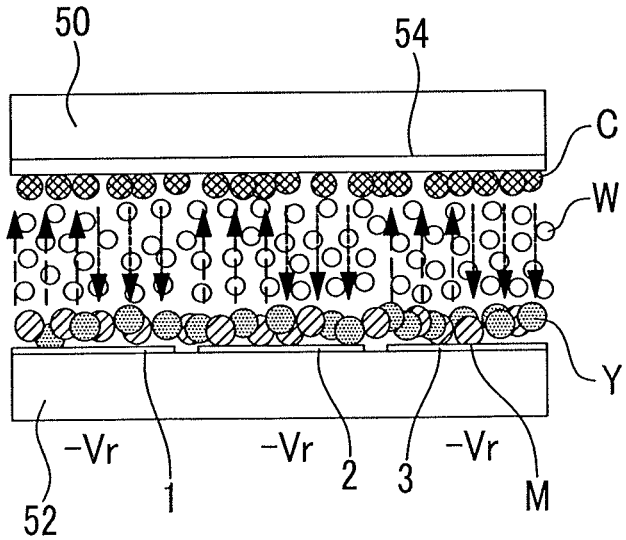

Then, as shown in FIG. 22D, a voltage −Vr that is equal to or lower than the threshold voltage −V3 of the magenta particle M is applied to the electrodes 1 to 3. That is, the voltage −Vr satisfying |V3|<|Vr| is applied to the electrodes 1 to 3 such that all magenta particles M which are arranged above the electrodes 1 to 3 so as to be close to the display substrate 50 move to the rear substrate 52. In this way, as shown in FIG. 22D, all magenta particles M which are arranged above the electrodes 1 to 3 so as to be close to the display substrate 50 move to the rear substrate 52. As shown in FIG. 22B, since there is no magenta particle M which is arranged above the electrodes 1 and 3 so as to be close to the display substrate 50, in practice, the magenta particles M which are arranged above the electrode 2 so as to be close to the display substrate 50 move to the rear substrate 52. In this way, the display of magenta is reset. With the reset of the display, the yellow particles Y which are arranged above the electrodes 1 to 3 so as to be close to the display substrate 50 move to the rear substrate 52 and the cyan particles C which are arranged above the electrodes 1 to 3 so as to be close to the rear substrate 52 move to the display substrate 50.

Figure 22E:
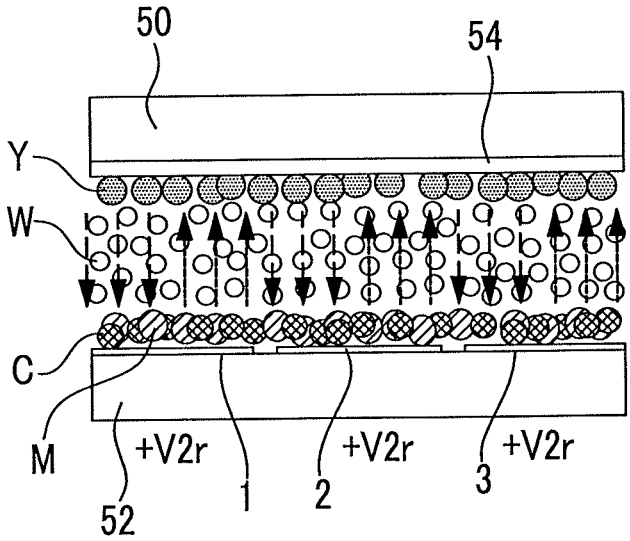

As shown in FIG. 22E, a voltage +V2*r* that is equal to or higher than the threshold voltage +V2 of the cyan particle C and is lower than the movement start voltage +V3*a* of the magenta particle M is applied to the electrodes 1 to 3. That is, the voltage +V2*r* satisfying |V2|≤|V2*r*|<|V3*a*| is applied to the electrodes 1 to 3 such that the cyan particles C which are arranged above the electrodes 1 to 3 so as to be close to the display substrate 50 move to the rear substrate 52. In this way, as shown in FIG. 22E, all cyan particles C which are arranged above the electrodes 1 to 3 so as to be close to the display substrate 50 move to the rear substrate 52 and display is reset again. In this way, the display of cyan is reset. With the reset of the display, the yellow particles Y which are arranged above the electrodes 1 to 3 so as to be close to the rear substrate 52 move to the display substrate 50.

Figure 22F:
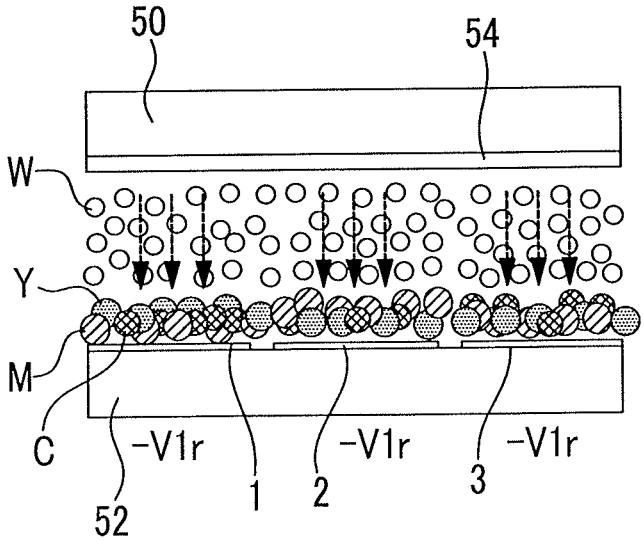

Then, as shown in FIG. 22F, a voltage −V1*r* that is equal to or lower than the threshold voltage −V1 of the yellow particle Y and is higher than the movement start voltage −V2*a* of the cyan particle C is applied to the electrodes 1 to 3. That is, the voltage +V1*r* satisfying |V1|≤|V1*r*|<|V2*a*| is applied to the electrodes 1 to 3 such that the yellow particles Y which are arranged above the electrodes 1 to 3 so as to be close to the display substrate 50 move to the rear substrate 52. In this way, as shown in FIG. 22F, all yellow particles Y which are arranged above the electrodes 1 to 3 so as to be close to the display substrate 50 move to the rear substrate 52 and display is reset again. In this way, the display of yellow is reset and white is displayed on the entire surface.

In Step S14 of FIG. 3, the CPU 40A determines a display color voltage to be applied to a rear-surface-side electrode 56 on the basis of the acquired image information and notifies a voltage applying unit 30 of the display color voltage. The voltage applying unit 30 applies the display color voltage notified by the control unit 40 to the rear-surface-side electrode 56.

Next, for example, the flow of the application of the voltage when the state is changed from the reset state shown in FIG. 22F to the image display state shown in FIG. 22A will be described with reference to FIGS. 23A to 23E.

Figure 23A:
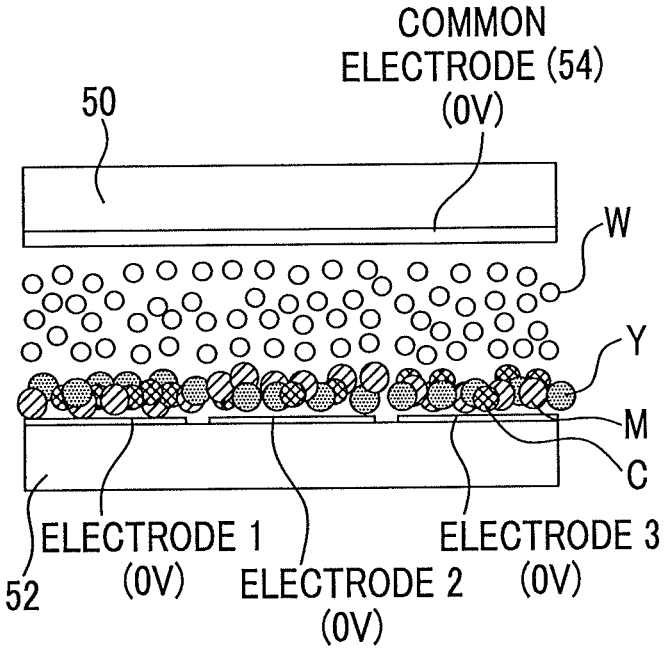
FIGS. 23A to 23E are schematic diagrams illustrating the movement of the migration particles when a voltage is applied in the seventh exemplary embodiment.
Figure 23B:
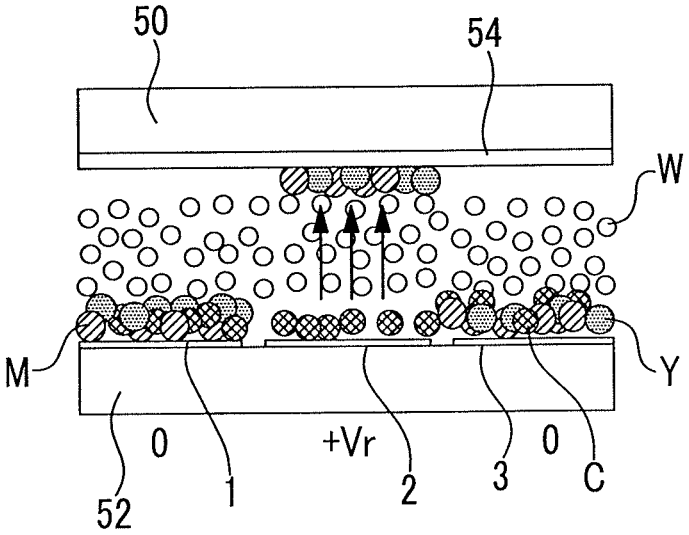
Figure 24:
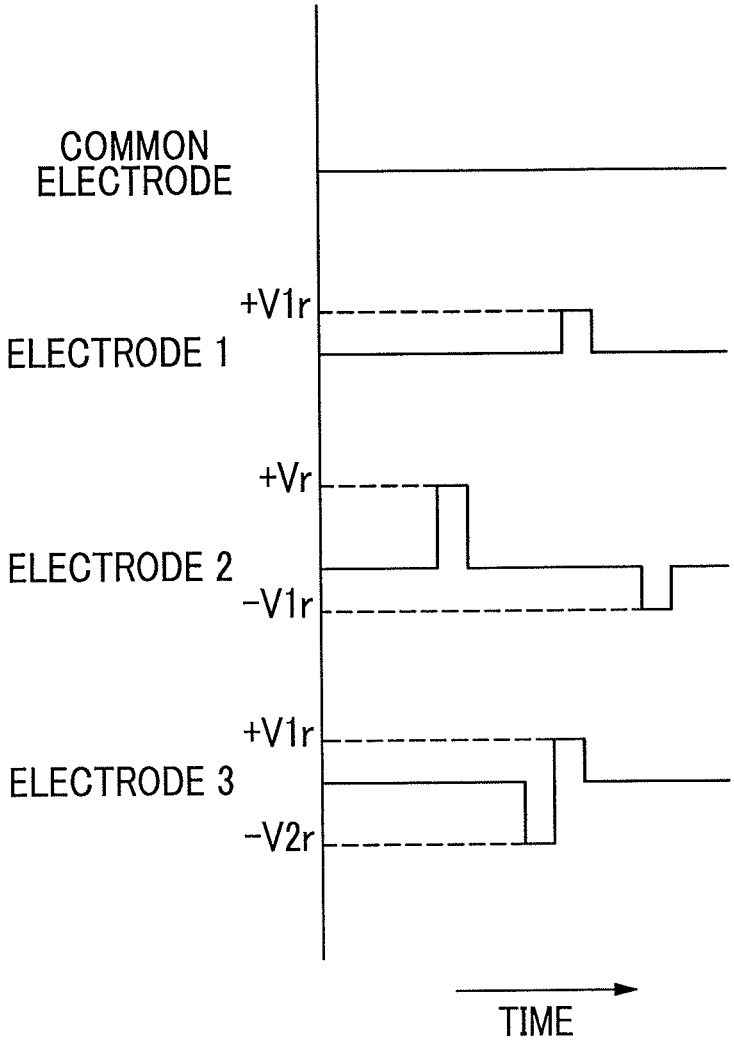
FIG. 24 is a diagram illustrating the waveform of the applied voltage in the seventh exemplary embodiment.

In the reset state in which all particles move to the rear substrate 52 as shown in FIG. 23A, a voltage +Vr that is equal to or higher than the threshold voltage +V3 of the magenta particle M is applied only to the electrode 2, as shown in FIG. 23B and FIG. 24. That is, the voltage +Vr satisfying |V3|≤|Vr| is applied to the electrode 2 such that the magenta particles M which are arranged above the electrode 2 so as to be close to the rear substrate 52 move to the display substrate 50. In this way, as shown in FIG. 23B, all of the magenta particles M and the yellow particles Y which are arranged above the electrode 2 so as to be close to the rear substrate 52 move to the display substrate 50.

Figure 23C:
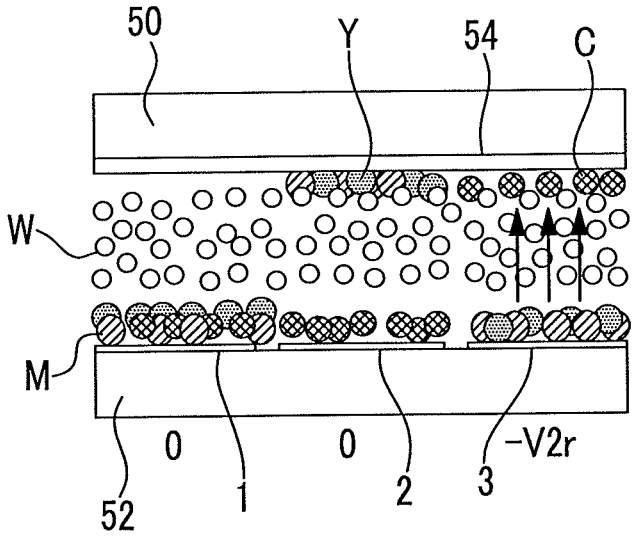

Then, as shown in FIG. 23C and FIG. 24, a voltage −V2*r* that is equal to or lower than the threshold voltage −V2 of the cyan particle C and is higher than the movement start voltage −V3*a* of the magenta particle M is applied to the electrode 3. That is, the voltage −V2*r* satisfying |V2|≤|V2*r*|<|V3*a*| is applied to the electrode 3 such that the cyan particles C which are arranged above the electrode 3 so as to be close to the rear substrate 52 move to the display substrate 50. In this way, as shown in FIG. 23C, all cyan particles C above the electrode 3 move to the display substrate 50.

Figure 23D:
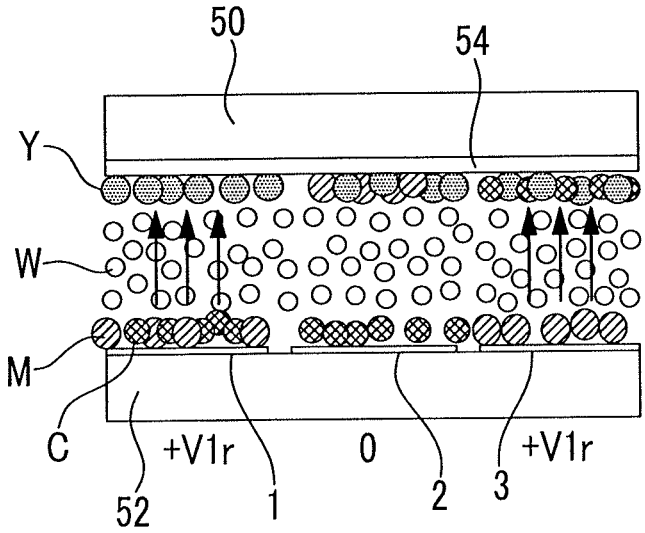

Then, as shown in FIG. 23D and FIG. 24, a voltage +V1*r* that is equal to or higher than the threshold voltage +V1 of the yellow particle Y and is lower than the movement start voltage +V2*a* of the cyan particle C is applied to the electrodes 1 and 3. That is, the voltage +V1*r* satisfying |V1|<|V1*r*| is applied to the electrodes 1 and 3 such that the yellow particles Y which are arranged above the electrodes 1 and 3 so as to be close to the rear substrate 52 move to the display substrate 50. No voltage is applied to the electrode 2 and the electrode 2 is maintained at 0 V. In this way, as shown in FIG. 23D, the yellow particles Y which are arranged above the electrodes 1 and 3 so as to be close to the rear substrate 52 move to the display substrate 50.

Figure 23E:
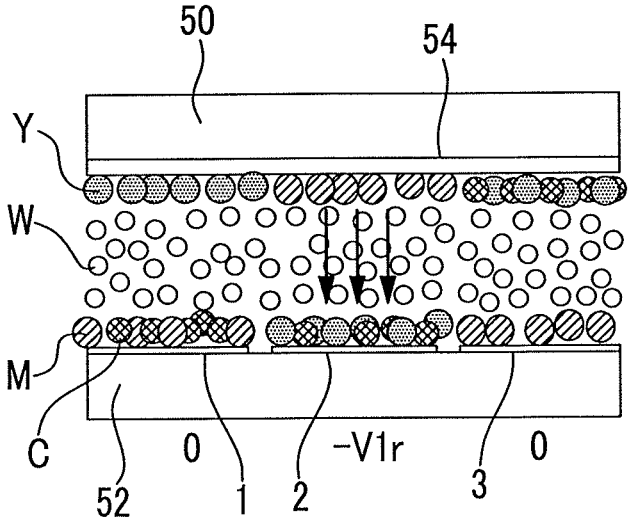

Then, as shown in FIG. 23E and FIG. 24, a voltage −V1*r* that is equal to or lower than the threshold voltage −V1 of the yellow particle Y and is higher than the movement start voltage −V2*a* of the cyan particle C is applied to the electrode 2. That is, the voltage −V1*r* satisfying |V1|<|V1*r*| is applied to the electrode 2 such that the yellow particles Y which are arranged above the electrode 2 so as to be close to the display substrate 50 move to the rear substrate 52. No voltage is applied to the electrodes 1 and 3 and the electrodes 1 and 3 are maintained at 0 V. In this way, as shown in FIG. 23E, the yellow particles Y which are arranged above the electrode 2 so as to be close to the display substrate 50 move to the rear substrate 52. In this way, yellow formed by the yellow particles Y is displayed on a portion of the display substrate corresponding to the first electrode, magenta formed by the magenta particles M is displayed on a portion of the display substrate corresponding to the second electrode, and green, which is a secondary color formed by the yellow particles Y and the cyan particles C, is displayed on a portion of the display substrate corresponding to the third electrode. When black is displayed, all of the yellow particles Y, the cyan particles C, and the magenta particles M move to the display substrate to display black which is a tertiary color.

As described above, in this exemplary embodiment, when the previously displayed image is reset, the reset voltage is applied to each of the particle groups with different colors in ascending order of the threshold voltage. Therefore, the non-uniform distribution of particles for each pixel due to the image which is displayed in the reset state is prevented.

Eighth Exemplary Embodiment

An eighth exemplary embodiment will be described. In the eighth exemplary embodiment, the same components as those in the seventh exemplary embodiment are denoted by the same reference numerals and the detailed description thereof will not be repeated.

In this exemplary embodiment, a case in which display is reset for each particle group of different colors according to the image which is being displayed in ascending order of a threshold voltage will be described. The device structure and the threshold characteristics of each particle are the same as those in the seventh exemplary embodiment and thus the description thereof will not be repeated.

For control performed by a CPU 40A of a control unit 40, the process in Steps S10 and S14 in FIG. 3 is the same as that in the seventh exemplary embodiment and the description thereof will not be repeated. The application of a reset voltage in Step S12 will be described.

Figure 25A:
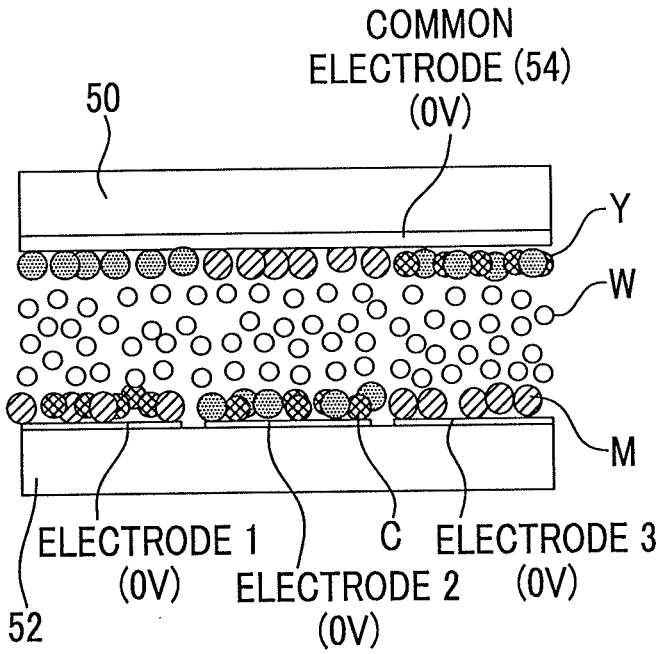
FIGS. 25A to 25F are schematic diagrams illustrating the movement of migration particles when a voltage is applied in an eighth exemplary embodiment.

FIGS. 25A to 25F show an aspect of the movement of particles when a reset voltage is applied to each of the particle groups with different colors in ascending order of the threshold voltage according to the image which is being displayed. FIG. 25A shows a state in which the previous image is displayed and is the same as FIG. 22A.

Figure 25B:
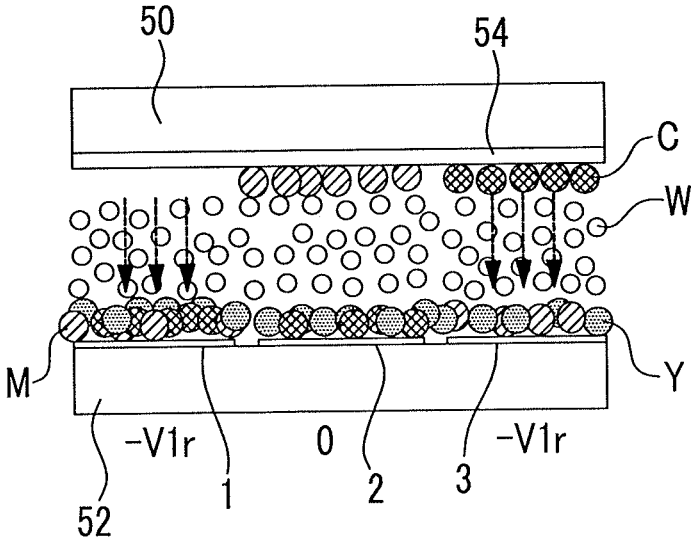

In this state, as shown in FIG. 25B, a voltage $-V1r$ that is equal to or lower than the threshold voltage $-V1$ of a yellow particle Y and is higher than the movement start voltage $-V2a$ of a cyan particle C is applied to electrodes 1 and 3. That is, the voltage $-V1r$ satisfying $|V1|\leq|V1r|<|V2a|$ is applied to the electrodes 1 to 3 such that the yellow particles Y which are arranged above the electrodes 1 and 3 so as to be close to a display substrate 50 move to a rear substrate 52. In this way, as shown in. FIG. 25B, all yellow particles Y which are arranged above the electrodes 1 and 3 so as to be close to the display substrate 50 move to the rear substrate 52.

Figure 25C:
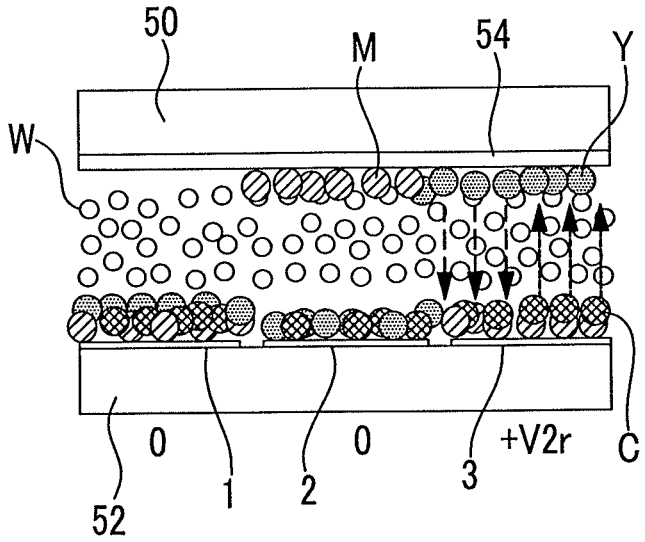

Then, as shown in FIG. 25C, a voltage $+V2r$ that is equal to or higher than the threshold voltage $+V2$ of the cyan particle C and is lower than the movement start voltage $+V3a$ of a magenta particle M is applied to the electrode 3. That is, the voltage $+V2r$ satisfying $|V2|\leq|V2r|<|V3a|$ is applied to the electrode 3 such that the cyan particles C which are arranged above the electrode 2 so as to be close to the display substrate 50 move to the rear substrate 52. In this way, as shown in FIG. 25C, all cyan particles C which are arranged above the electrode 3 so as to be close to the display substrate 50 move to the rear substrate 52 and the yellow particles Y which are arranged above the electrode 3 so as to be close to the rear substrate 52 move to the display substrate 50.

Figure 25D:
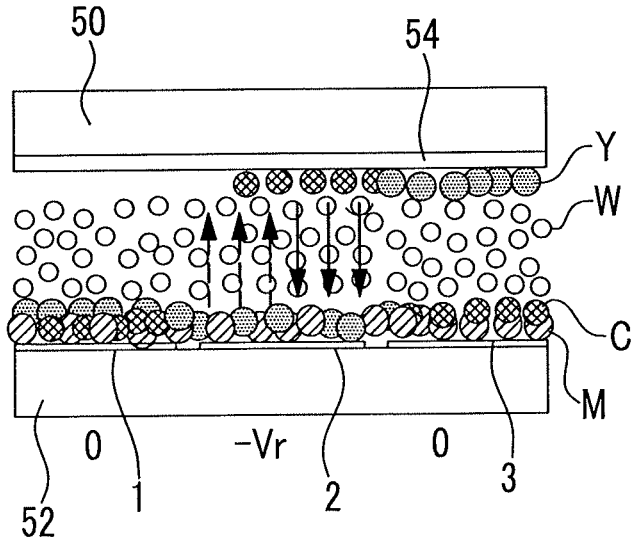

Then, as shown in FIG. 25D, a voltage $-Vr$ that is equal to or lower than the threshold voltage $-V3$ of the magenta particle M is applied to the electrode 2. That is, the voltage $-Vr$ satisfying $|V3|<|Vr|$ is applied to the electrode 2 such that all magenta particles M which are arranged above the electrode 2 so as to be close to the display substrate 50 move to the rear substrate 52. In this way, as shown in FIG. 25D, all magenta particles M which are arranged above the electrode 2 so as to be close to the display substrate 50 move to the rear substrate 52 and the cyan particles C which are arranged above the electrode 2 so as to be close to the rear substrate 52 move to the display substrate 50. Therefore, the display of magenta is reset.

Figure 25E:
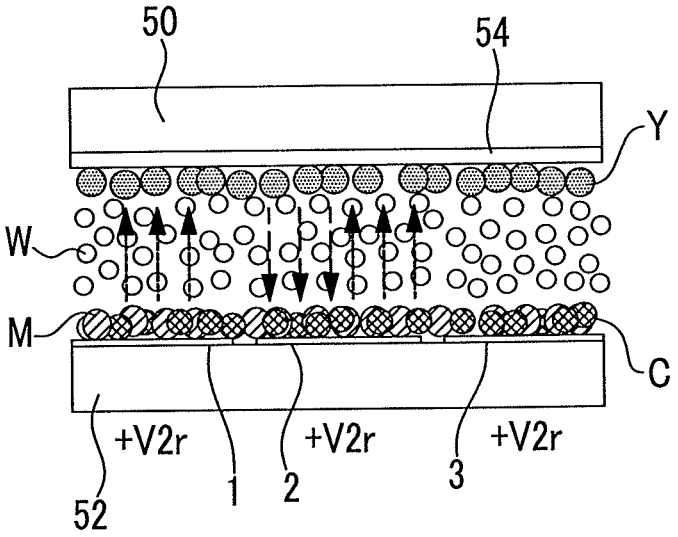

Then, as shown in FIG. 25E, a voltage $+V2r$ that is equal to or higher than the threshold voltage $+V2$ of the cyan particle C and is lower than the movement start voltage $+V3a$ of the magenta particle M is applied to the electrodes 1 to 3. That is, the voltage $+V2r$ satisfying $|V2|\leq|V2r|<|V3a|$ is applied to the electrodes 1 to 3 such that the cyan particles C which are arranged above the electrodes 1 to 3 so as to be close to the display substrate 50 move to the rear substrate 52. In this way, as shown in FIG. 25E, all cyan particles C which are arranged above the electrodes 1 to 3 move to the rear substrate 52. However, in this exemplary embodiment, since the cyan particles above the electrodes 1 and 3 are arranged close to the rear substrate 52, only the cyan particles C which are arranged above the electrode 2 so as to be close to the display substrate 50 move to the rear substrate 52 and the yellow particles Y which are arranged above the electrodes 1 and 2 so as to be close to the rear substrate 52 move to the display substrate 50. In this way, the display of cyan is reset.

Figure 25F:
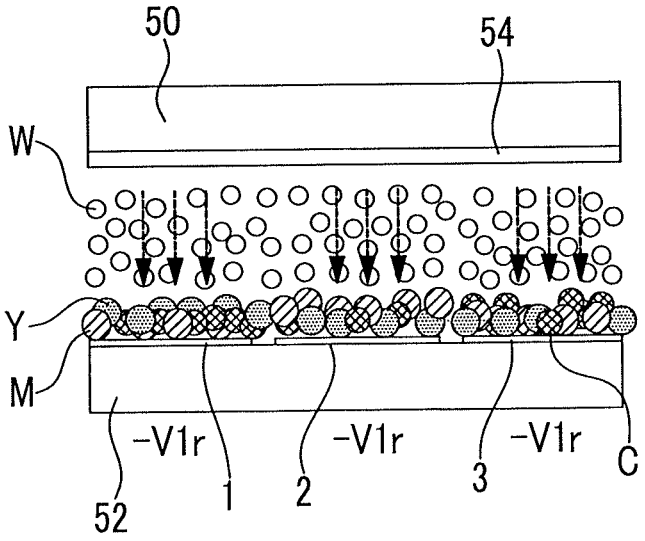

Then, as shown in FIG. 25F, a voltage $-V1r$ that is equal to or lower than the threshold voltage $-V1$ of the yellow particle Y and is higher than the movement start voltage $-V2a$ of the cyan particle C is applied to the electrodes 1 to 3. That is, the voltage $+V1r$ satisfying $|V1|\leq|V1r|<|V2a|$ is applied to the electrodes 1 to 3 such that the yellow particles Y which are arranged above the electrodes 1 to 3 so as to be close to the display substrate 50 move to the rear substrate 52. In this way, as shown in FIG. 25F, all yellow particles Y which are arranged above the electrodes 1 to 3 so as to be close to the display substrate 50 move to the rear substrate 52. Therefore, the display of yellow is reset.

As such, in this exemplary embodiment, when the previously displayed image is reset, each of the particle groups with different colors moves to the rear substrate 52 in ascending order of the threshold voltage according to the image which is being displayed to reset the display of each color. Therefore, the non-uniform distribution of particles for each pixel due to the image which is displayed in the reset state is prevented, as compared to a case in which display is reset regardless of the image which is being displayed.

Ninth Exemplary Embodiment

Next, a ninth exemplary embodiment will be described. In the ninth exemplary embodiment, the same components as those in the seventh exemplary embodiment are denoted by the same reference numerals and the detailed description thereof will not be repeated.

In this exemplary embodiment, a case in which display is reset for each of particle groups with different colors in descending order of a threshold voltage according to the image which is being displayed will be described. The device structure and the threshold characteristics of each particle are the same as those in the seventh exemplary embodiment and thus the description thereof will not be repeated.

For control performed by a CPU 40A of a control unit 40, the process in Steps S10 and S14 in FIG. 3 is the same as that in the seventh exemplary embodiment and the description thereof will not be repeated. The application of a reset voltage in Step S12 will be described.

Figure 26A:
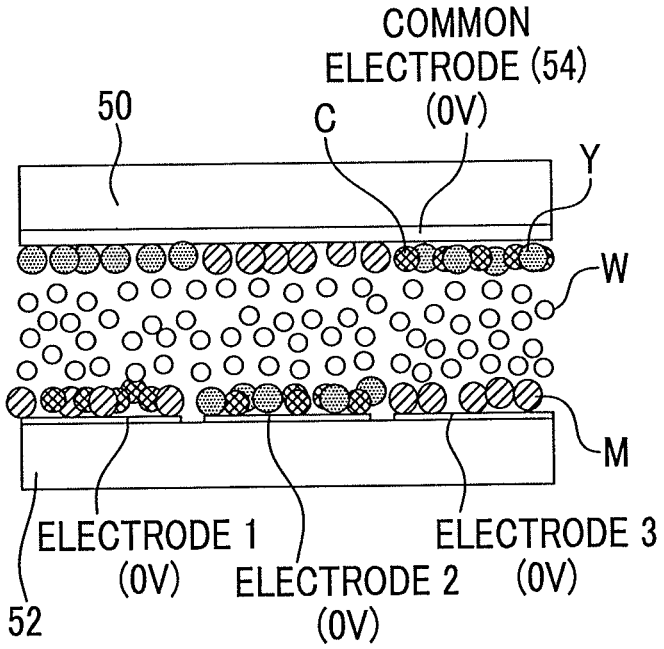
FIGS. 26A to 26F are schematic diagrams illustrating the movement of migration particles when a voltage is applied in a ninth exemplary embodiment.

FIGS. 26A to 26F show an aspect of the movement of particles when a reset voltage is applied to each of particle groups with different colors in descending order of the threshold voltage according to the image which is being displayed. FIG. 26A shows a state in which the previous image is displayed and is the same as FIG. 22A.

Figure 26B:
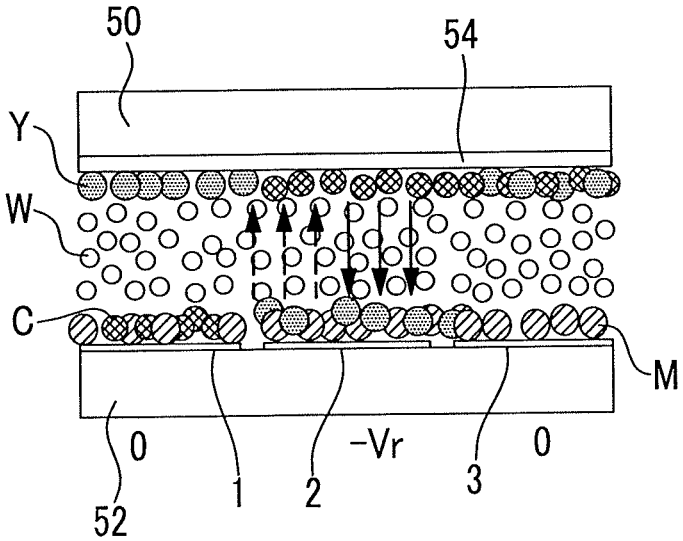

In this state, as shown in FIG. 26B, a voltage $-Vr$ that is equal to or lower than the threshold voltage $-V3$ of a magenta particle M is applied only to an electrode 2. That is, the voltage $-Vr$ satisfying $|V3|\leq|Vr|$ is applied only to the electrode 2 such that the magenta particles M which are arranged above the electrode 2 so as to be close to a display substrate 50 move to a rear substrate 52. In this way, as shown in FIG. 26B, all magenta particles M which are arranged above the electrode 2 so as to be close to the display substrate 50 move to the rear substrate 52 and cyan particles C which are disposed close to the rear substrate 52 move to the display substrate 50. In this way, the display of magenta is reset.

Figure 26C:
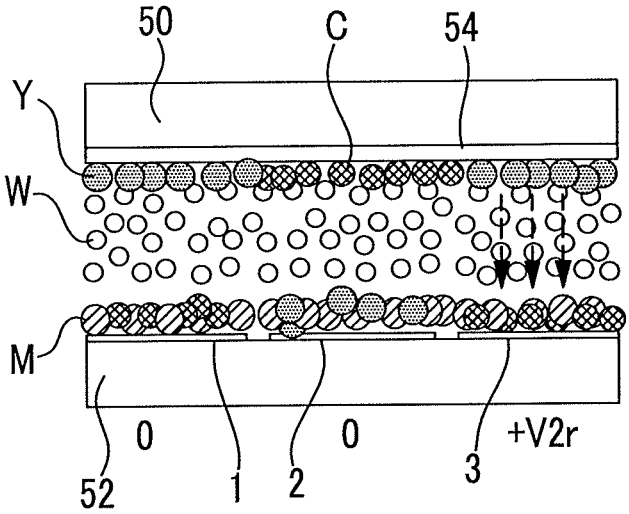

Then, as shown in FIG. 26C, a voltage +V2*r* that is equal to or higher than the threshold voltage +V2 of the cyan particle C and is lower than the movement start voltage +V3*a* of the magenta particle M is applied only to the electrode 3. That is, the voltage +V2*r* satisfying |V2|≤|V2*r*|<|V3*a*| is applied only to the electrode 3 such that the cyan particles C which are arranged above the electrode 3 so as to be close to the display substrate 50 move to the rear substrate 52. In this way, as shown in FIG. 26C, all cyan particles C which are arranged above the electrode 3 so as to be close to the display substrate 50 move to the rear substrate 52.

Figure 26D:
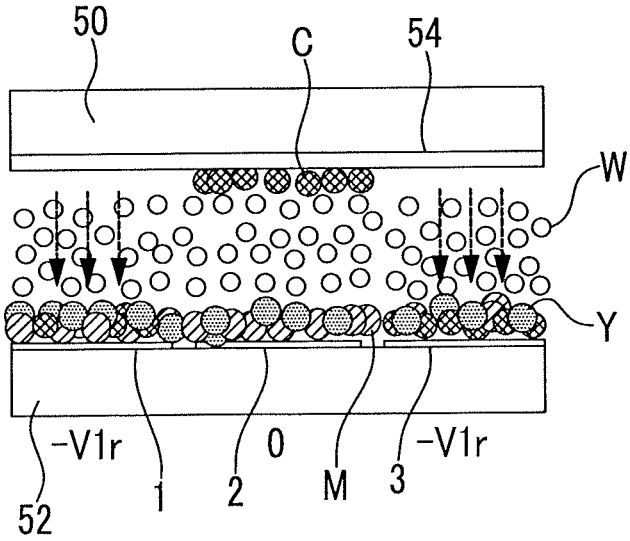

Then, as shown in FIG. 26D, a voltage −V1*r* that is equal to or lower than the threshold voltage −V1 of the yellow particle Y and is higher than the movement start voltage −V2*a* of the cyan particle C is applied to the electrodes 1 and 3. That is, the voltage −V1*r* satisfying |V1|≤|V1*r*|<|V2*a*| is applied to the electrodes 1 and 3 such that all yellow particles Y which are arranged above the electrodes 1 and 3 so as to be close to the display substrate 50 move to the rear substrate 52. In this way, as shown in FIG. 26D, all yellow particles Y which are arranged above the electrodes 1 and 3 so as to be close to the display substrate 50 move to the rear substrate 52.

Figure 26E:
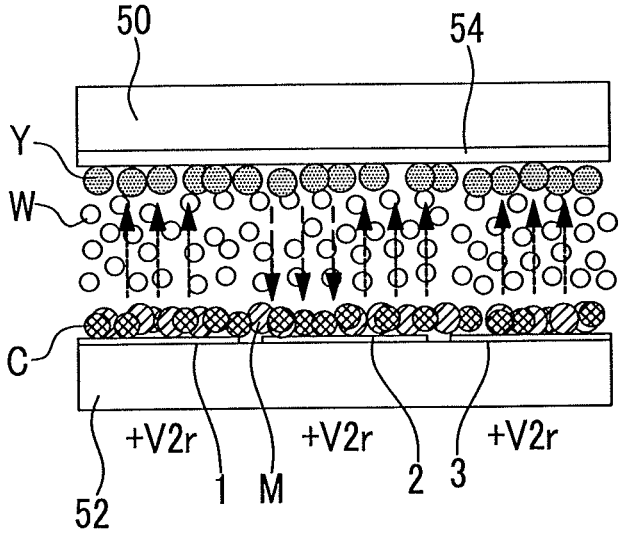

Then, as shown in FIG. 26E, a voltage +V2*r* that is equal to or higher than the threshold voltage +V2 of the cyan particle C and is lower than the movement start voltage +V3*a* of the magenta particle M is applied to the electrodes 1 to 3. That is, the voltage −V2*r* satisfying |V2|≤|V2*r*|<|V3*a*| is applied to the electrodes 1 to 3 such that the cyan particles C which are arranged above the electrodes 1 to 3 so as to be close to the display substrate 50 move to the rear substrate 52. In this way, as shown in FIG. 26E, all cyan particles C which are arranged above the electrodes 1 to 3 so as to be close to the display substrate 50 move to the rear substrate 52 and the yellow particles Y which are arranged above the electrodes 1 to 3 so as to be close to the rear substrate 52 move to the display substrate 50. In this way, the display of cyan is reset.

Figure 26F:
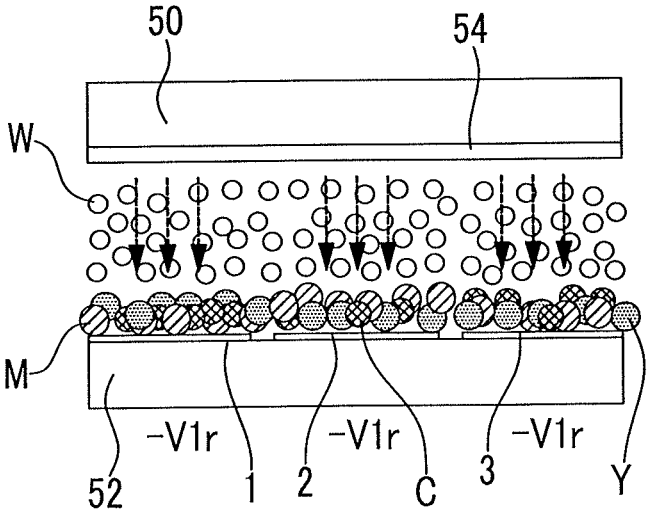

Then, as shown in FIG. 26F, a voltage −V1*r* that is equal to or lower than the threshold voltage −V1 of the yellow particle Y and is higher than the movement start voltage −V2*a* of the cyan particle C is applied to the electrodes 1 to 3. That is, the voltage +V1*r* satisfying |V1|≤|V1*r*|<|V2*a*| is applied to the electrodes 1 to 3 such that the yellow particles Y which are arranged above the electrodes 1 to 3 so as to be close to the display substrate 50 move to the rear substrate 52. In this way, as shown in FIG. 26F, all yellow particles Y which are arranged above the electrodes 1 to 3 so as to be close to the display substrate 50 move to the rear substrate 52. In this way, the display of yellow is reset.

As such, in this exemplary embodiment, when the previously displayed image is reset, each of the particle groups with different colors moves to the rear substrate 52 in descending order of the threshold voltage according to the image which is being displayed to reset the display of each color. Therefore, the non-uniform distribution of particles for each pixel due to the image which is displayed in the reset state is prevented, as compared to a case in which display is reset regardless of the image which is being displayed.

Tenth Exemplary Embodiment

Next, a tenth exemplary embodiment will be described. In the tenth exemplary embodiment, the same components as those in the seventh exemplary embodiment are denoted by the same reference numerals and the detailed description thereof will not be repeated.

In this exemplary embodiment, a case in which a reset voltage is applied to each of particle groups with different colors and the next reset voltage is applied according to the image displayed by the application of the reset voltage will be described. The device structure and the threshold characteristics of each particle are the same as those in the seventh exemplary embodiment and thus the description thereof will not be repeated.

For control performed by a CPU 40A of a control unit 40, the process in Steps S10 and S14 in FIG. 3 is the same as that in the seventh exemplary embodiment and the description thereof will not be repeated. The application of a reset voltage in Step S12 will be described.

Figure 27A:
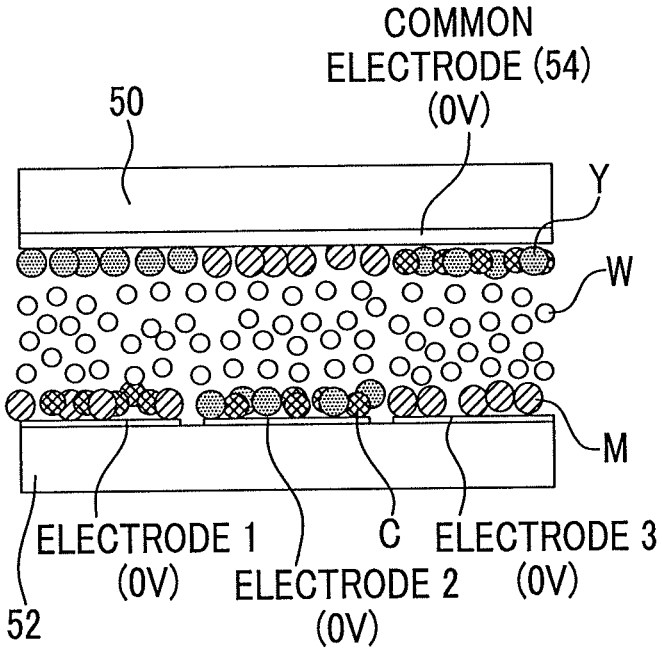
FIGS. 27A to 27D are schematic diagrams illustrating the movement of migration particles when a voltage is applied in a tenth exemplary embodiment.

FIGS. 27A to 27D show an aspect of the movement of particles when a reset voltage is applied to each of particle groups with different colors and the next reset voltage is applied according to the image displayed by the application of the reset voltage. FIG. 27A shows a state in which the previous image is displayed and is the same as FIG. 22A.

Figure 27B:
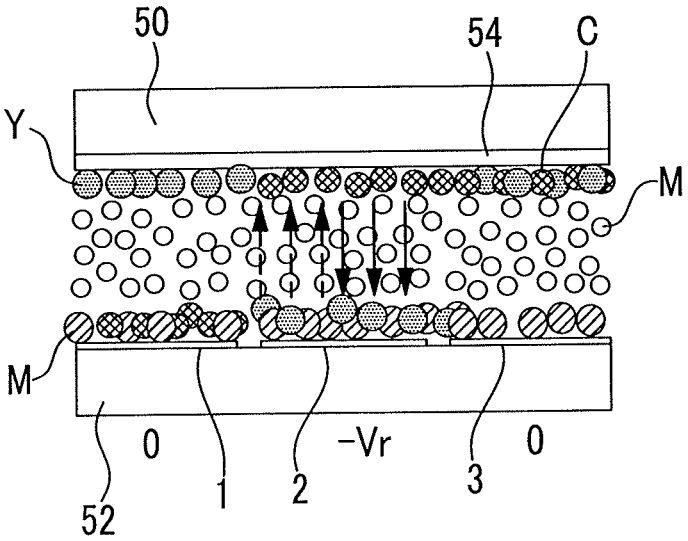

In this state, as shown in FIG. 27B, a voltage −Vr that is equal to or lower than the threshold voltage −V3 of the magenta particle M is applied only to the electrode 2. That is, the voltage −Vr satisfying |V3|≤|Vr| is applied only to the electrode 2 such that the magenta particles M which are arranged above the electrode 2 so as to be close to the display substrate 50 move to the rear substrate 52. In this way, as shown in FIG. 27B, all magenta particles M which are arranged above the electrode 2 so as to be close to the display substrate 50 move to the rear substrate 52 and the cyan particles C which are arranged close to the rear substrate 52 move to the display substrate 50. Therefore, the display of magenta is reset.

As shown in FIG. 27B, the next cyan particles C to be reset are arranged above the electrodes 2 and 3 so as to be close to the display substrate 50.

Figure 27C:
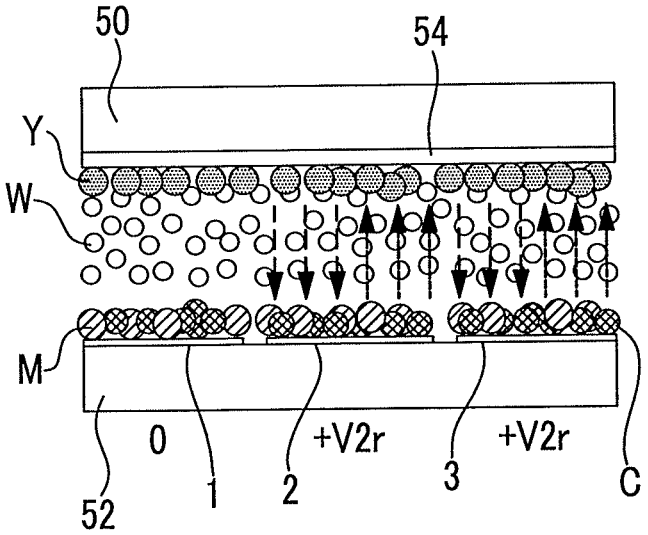

Then, as shown in FIG. 27C, a voltage +V2*r* that is equal to or higher than the threshold voltage +V2 of the cyan particle C and is lower than the movement start voltage +V3*a* of the magenta particle M is applied to the electrodes 2 and 3. That is, the voltage +V2*r* satisfying |V2|≤|V2*r*|<|V3*a*| is applied only to the electrode 3 such that the cyan particles C which are arranged above the electrodes 2 and 3 so as to be close to the display substrate 50 move to the rear substrate 52. In this way, as shown in FIG. 27C, all cyan particles C which are arranged above the electrodes 2 and 3 so as to be close to the display substrate 50 move to the rear substrate 52. Therefore, the display of cyan is reset.

As shown in FIG. 27C, the next yellow particles Y to be reset are arranged above the electrodes 1 to 3 so as to be close to the display substrate 50.

Figure 27D:
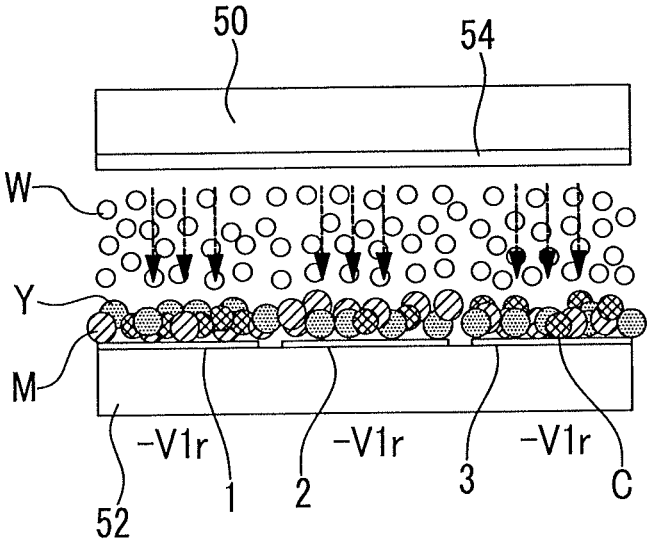

Then, as shown in FIG. 27D, a voltage −V1*r* that is equal to or lower than the threshold voltage −V1 of the yellow particle Y and is higher than the movement start voltage −V2*a* of the cyan particle C is applied to the electrodes 1 to 3. That is, the voltage −V1*r* satisfying |V1|≤|V1*r*|<|V2*a*| is applied to the electrodes 1 to 3 such that all yellow particles Y which are arranged above the electrodes 1 to 3 so as to be close to the display substrate 50 move to the rear substrate 52. In this way, as shown in FIG. 27D, all yellow particles Y which are arranged above the electrodes 1 to 3 so as to be close to the display substrate 50 move to the rear substrate 52. Therefore, the display of yellow is reset.

As such, in this exemplary embodiment, when the previously displayed image is reset, a reset voltage is applied to each of the particle groups with different colors and the next reset voltage is applied according to the image displayed by the application of the reset voltage. That is, whenever the reset voltage is applied, the next reset voltage is determined according to the previously displayed image. Therefore, the non-uniform distribution of particles for each pixel due to the image which is displayed in the reset state is prevented and the number of times the reset voltage is applied is reduced.

Eleventh Exemplary Embodiment

Next, an eleventh exemplary embodiment will be described. In the eleventh exemplary embodiment, the same components as those in the seventh exemplary embodiment are denoted by the same reference numerals and the detailed description thereof will not be repeated.

In this exemplary embodiment, a case will be described in which a reverse image of the image which is being displayed is sequentially displayed for each color of the particle groups with different colors in ascending order of a threshold voltage and a reset voltage is applied such that the particle groups of each color move to a display substrate 50 or a rear substrate 52. The device structure and the threshold characteristics of each particle are the same as those in the seventh exemplary embodiment and thus the description thereof will not be repeated.

For control performed by a CPU 40A of a control unit 40, the process in Steps S10 and S14 in FIG. 3 is the same as that in the seventh exemplary embodiment and the description thereof will not be repeated. The application of a reset voltage in Step S12 will be described.

Figure 28A:
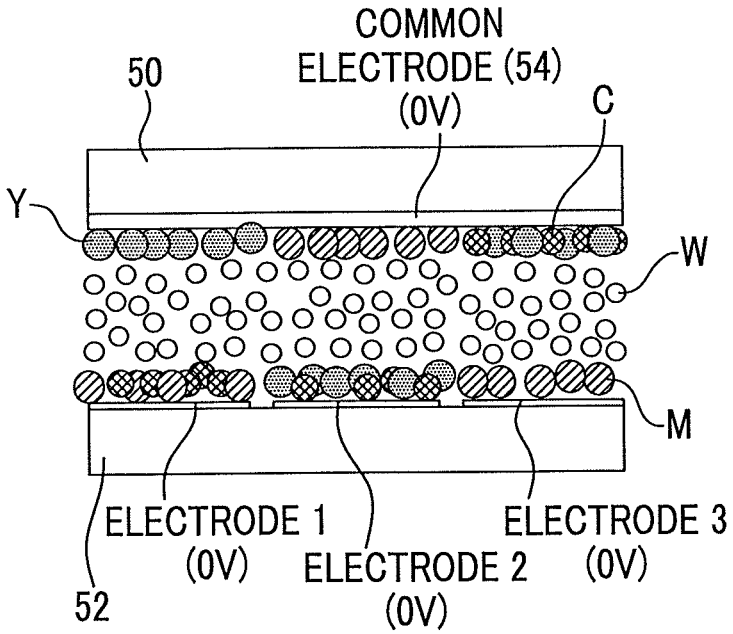
FIGS. 28A to 28D are schematic diagrams illustrating the movement of migration particles when a voltage is applied in an eleventh exemplary embodiment.

FIGS. 28A to 28D show an aspect of the movement of particles when the reverse image of the image which is being displayed is sequentially displayed for each color of the particle groups with different colors in ascending order of the threshold voltage and the reset voltage is applied such that the particle groups of each color move to the display substrate 50 or the rear substrate 52. FIG. 28A shows a state in which the previous image is displayed and is the same as FIG. 22A.

Figure 29A:
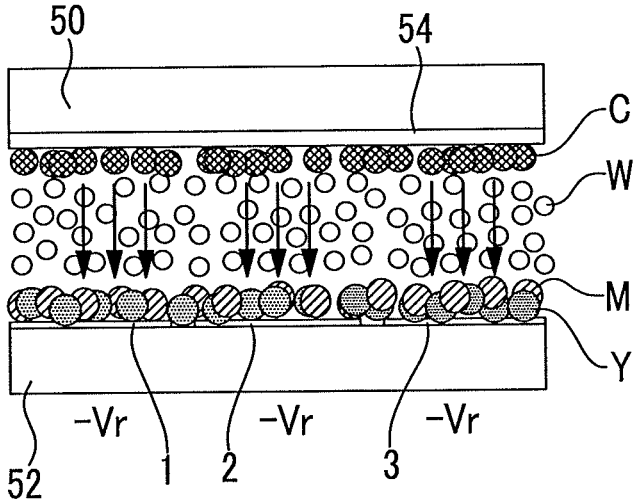
FIGS. 29A to 29C are schematic diagrams illustrating the movement of migration particles when a voltage is applied in the eleventh exemplary embodiment.

As shown in FIG. 29A, in the image which is being displayed, yellow is displayed on pixels corresponding to an electrode 1 by yellow particles Y, magenta is displayed on pixels corresponding to an electrode 2 by magenta particles M, and green, which is a mixed color of cyan particles C and the yellow particles Y, is displayed on pixels corresponding to an electrode 3.

It is necessary to move the yellow particles Y to the display substrate 50 above the electrode 2 in order to write a reverse image of a yellow image formed by the yellow particles Y with the lowest threshold voltage. It is necessarily to move the cyan particles C to the display substrate 50 above the electrodes 1 and 2 in order to write a reverse image of a cyan image formed by the cyan particles C with the second lowest threshold voltage. It is necessary to move the magenta particles M to the display substrate 50 above the electrodes 1 and 3 in order to write a reverse image of a magenta image formed by the magenta particles M with the highest threshold voltage.

Figure 28B:
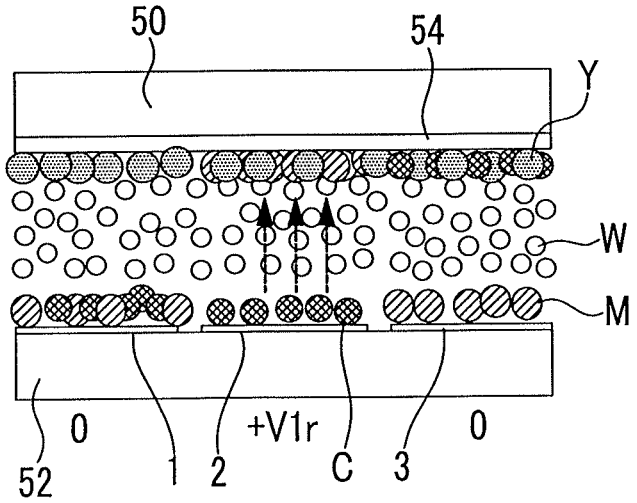

Therefore, as shown in FIG. 28B, a voltage +V1*r* that is equal to or higher than the threshold voltage +V1 of the yellow particle Y and is lower than the movement start voltage +V2*a* of the cyan particle C is applied to the electrode 2. That is, the voltage +V1*r* satisfying $|V1| \leq |V1r| < |V2a|$ is applied to the electrode 2 such that the yellow particles Y which are arranged above the electrode 2 so as to be close to the rear substrate 52 move to the display substrate 50. In this way, as shown in FIG. 28B, all yellow particles Y which are arranged above the electrode 2 so as to be close to the rear substrate 52 move to the display substrate 50. Therefore, the reverse image of the yellow image is written.

Figure 28C:
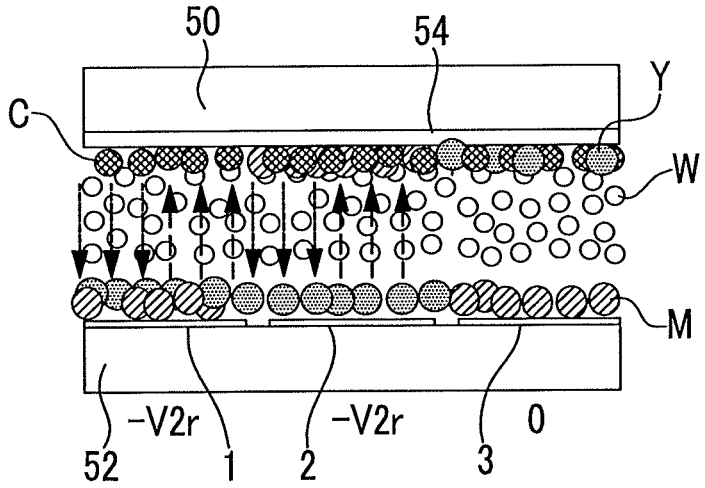

Then, as shown in FIG. 28C, a voltage −V2*r* that is equal to or lower than the threshold voltage −V2 of the cyan particle C and is higher than the movement start voltage −V3*a* of the magenta particle M is applied to the electrodes 1 and 2. That is, the voltage −V2*r* satisfying $|V2| \leq |V2r| < |V3a|$ is applied to the electrodes 1 and 2 such that the cyan particles C which are arranged above the electrodes 1 and 2 so as to be close to the rear substrate 52 move to the display substrate 50. In this way, as shown in FIG. 28C, all cyan particles C which are arranged above the electrodes 1 and 2 so as to be close to the rear substrate 52 move to the display substrate 50 and the yellow particles Y which are arranged above the electrodes 1 and 2 so as to be close to the display substrate 50 move to the rear substrate 52. Therefore, the reverse image of the cyan image is written.

Figure 28D:
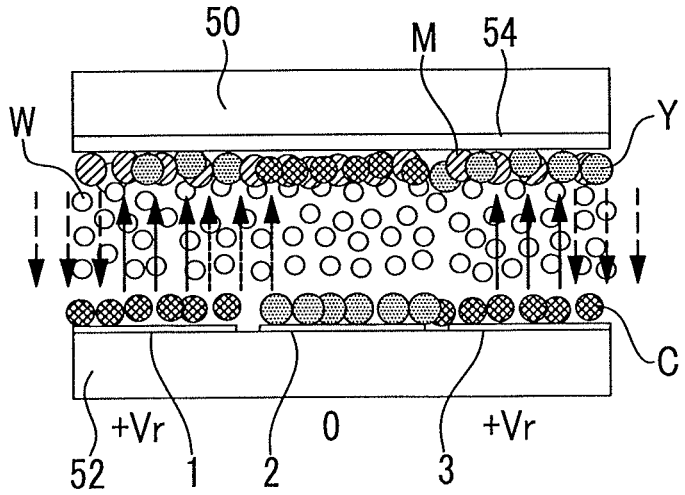

Then, as shown in FIG. 28D, a voltage +Vr that is equal to or higher than the threshold voltage +V3 of the magenta particle M is applied to the electrodes 1 and 3. That is, the voltage +Vr satisfying $|V3| < |Vr|$ is applied to the electrodes 1 and 3 such that all magenta particles M which are arranged above the electrodes 1 and 3 so as to be close to the rear substrate 52 move to the display substrate 50. In this way, as shown in FIG. 28D, all magenta particles M which are arranged above the electrodes 1 and 3 so as to be close to the rear substrate 52 move to the display substrate 50 and the cyan particles C which are arranged above the electrodes 1 and 3 so as to be close to the display substrate 50 move to the rear substrate 52. Therefore, the reverse image of the magenta image is written.

Then, as shown in FIG. 29A, a voltage −Vr that is equal to or lower than the threshold voltage −V3 of the magenta particle M is applied to the electrodes 1 to 3. That is, the voltage −Vr satisfying $|V3| \leq |Vr|$ is applied to the electrodes 1 to 3 such that the magenta particles M which are arranged above the electrodes 1 and 3 so as to be close to the display substrate 50 move to the rear substrate 52. In this way, as shown in FIG. 29A, all magenta particles M which are arranged above the electrodes 1 to 3 so as to be close to the display substrate 50 move to the rear substrate 52 and the cyan particles C which are arranged above the electrodes 1 to 3 so as to be close to the rear substrate 52 move to the display substrate 50.

Figure 29B:
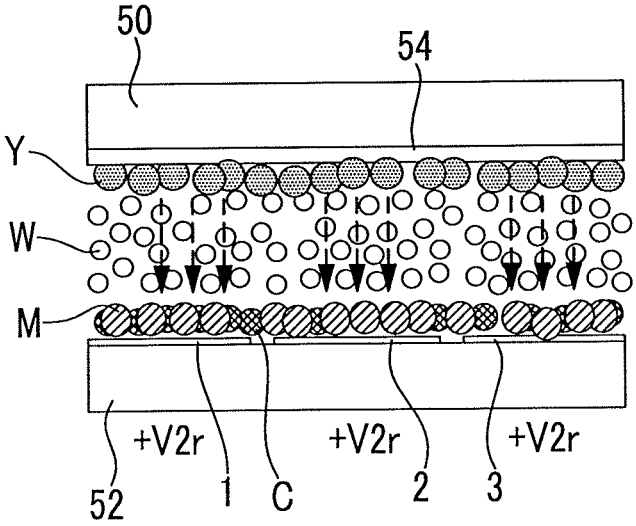

Then, as shown in FIG. 29B, a voltage +V2*r* that is equal to or higher than the threshold voltage +V2 of the cyan particle C and is lower than the movement start voltage +V3*a* of the magenta particle M is applied to the electrodes 1 to 3. That is, the voltage +V2*r* satisfying $|V2| \leq |V2r| \leq |V3a|$ is applied to the electrodes 1 to 3 such that the cyan particles C which are arranged above the electrodes 1 to 3 so as to be close to the display substrate 50 move to the rear substrate 52. In this way, as shown in FIG. 29B, all cyan particles C which are arranged above the electrodes 1 to 3 so as to be close to the display substrate 50 move to the rear substrate 52.

Figure 29C:
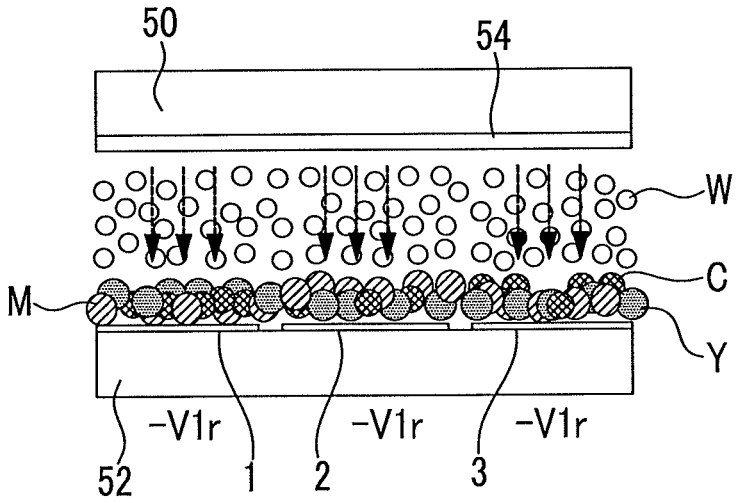

Then, as shown in FIG. 29C, a voltage −V1*r* that is equal to or lower than the threshold voltage −V1 of the yellow particle Y and is higher than the movement start voltage −V2*a* of the cyan particle C is applied to the electrodes 1 to 3. That is, the voltage +V1*r* satisfying $|V1| \leq |V1r| < |V2a|$ is applied to the electrodes 1 to 3 such that the yellow particles Y which are arranged above the electrodes 1 to 3 so as to be close to the display substrate 50 move to the rear substrate 52. In this way, as shown in FIG. 29C, all yellow particles Y which are arranged above the electrodes 1 to 3 so as to be close to the display substrate 50 move to the rear substrate 52. In the final stage of FIGS. 29A to 29C, the yellow particles Y, the cyan particles C, and the magenta particles M are all disposed close to the rear substrate 52 and white is displayed on the display surface.

The particle groups of each color move to the display substrate 50 or the rear substrate 52 at the time of FIG. 29A and reset is completed at this time. Therefore, the application of the voltage in FIGS. 29F and 29G may be omitted.

As such, in this exemplary embodiment, when the previously displayed image is reset, a reverse image of the image which is being displayed is sequentially displayed for each color of the particle groups with different colors in ascending order of the threshold voltage and the reset voltage is applied such that the particle groups of each color move to the display substrate 50 or the rear substrate 52. Therefore, the non-uniform distribution of particles for each pixel due to the image which is displayed in the reset state is prevented.

Twelfth Exemplary Embodiment

Next, a twelfth exemplary embodiment will be described. In the twelfth exemplary embodiment, the same components as those in the seventh exemplary embodiment are denoted by the same reference numerals and the detailed description thereof will not be repeated.

In this exemplary embodiment, a case will be described in which a reverse image of the image which is being displayed is sequentially displayed for each color of particle groups with different colors in descending order of a threshold voltage and a reset voltage is applied such that the particle groups of each color move to a display substrate 50 or a rear substrate 52. The device structure and the threshold characteristics of each particle are the same as those in the seventh exemplary embodiment and thus the description thereof will not be repeated.

For control performed by a CPU 40A of a control unit 40, the process in Steps S10 and S14 in FIG. 3 is the same as that in the seventh exemplary embodiment and the description thereof will not be repeated. The application of a reset voltage in Step S12 will be described.

Figure 30A:
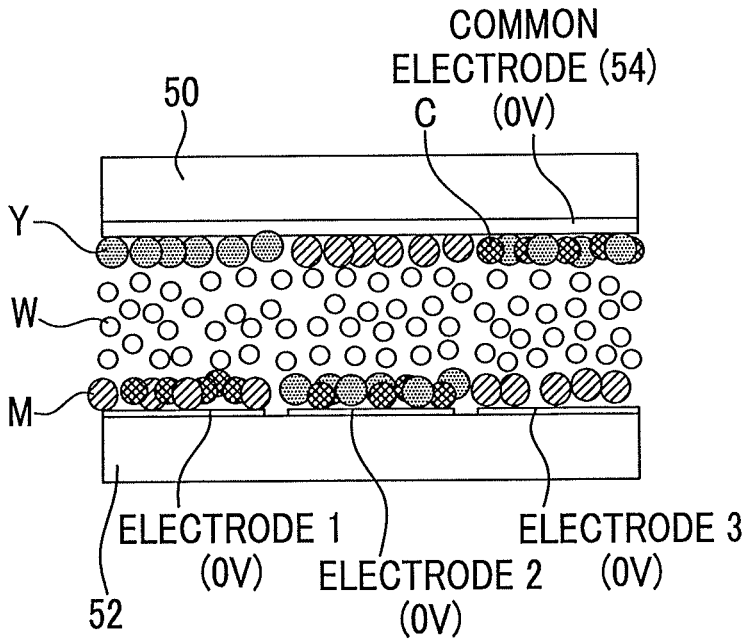
FIGS. 30A to 30D are schematic diagrams illustrating the movement of migration particles when a voltage is applied in a twelfth exemplary embodiment.

FIGS. 30A to 30D show an aspect of the movement of particles when the reverse image of the image which is being displayed is sequentially displayed for each color of the particle groups with different colors in descending order of the threshold voltage and the reset voltage is applied such that the particle groups of each color move to the display substrate 50 or the rear substrate 52. FIG. 30A shows a state in which the previous image is displayed and is the same as FIG. 22A.

As shown in FIG. 30A, in the image which is being displayed, yellow is displayed on pixels corresponding to an electrode 1 by yellow particles Y, magenta is displayed on pixels corresponding to an electrode 2 by magenta particles M, and green, which is a mixed color of cyan particles C and the yellow particles Y, is displayed on pixels corresponding to an electrode 3.

It is necessary to move the magenta particles M to the display substrate 50 above the electrodes 1 and 3 in order to write a reverse image of a magenta image formed by the magenta particles M with the highest threshold voltage. It is necessarily to move the cyan particles C to the display substrate 50 above the electrodes 1 and 2 in order to write a reverse image of a cyan image formed by the cyan particles C with the second highest threshold voltage. It is necessary to move the yellow particles Y to the display substrate 50 above the electrode 2 in order to write a reverse image of a yellow image formed by the yellow particles Y with the lowest threshold voltage.

Figure 30B:
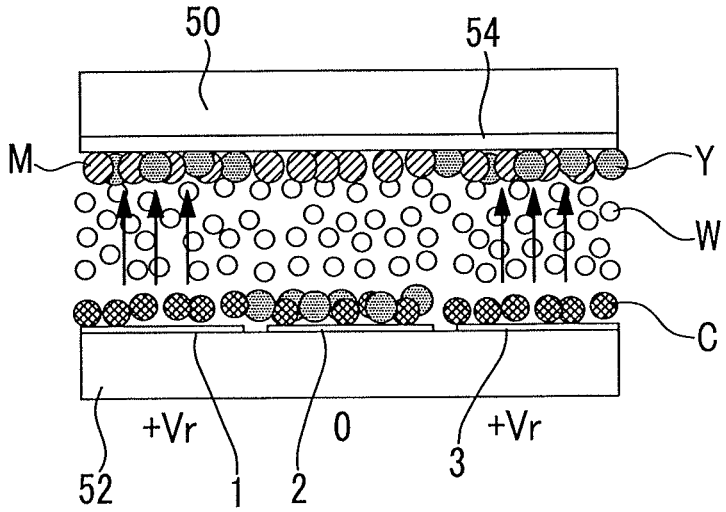

Therefore, as shown in FIG. 30B, a voltage +Vr that is equal to or higher than the threshold voltage +V3 of the magenta particle M is applied to the electrodes 1 and 3. That is, the voltage +Vr satisfying $|V3|<|Vr|$ is applied to the electrodes 1 and 3 such that all magenta particles M which are arranged above the electrodes 1 and 3 so as to be close to the rear substrate 52 move to the display substrate 50. In this way, as shown in FIG. 30B, all magenta particles M which are arranged above the electrodes 1 and 3 so as to be close to the rear substrate 52 move to the display substrate 50 and the cyan particles C which are arranged above the electrode 3 so as to be close to the display substrate 50 move to the rear substrate 52. In this way, the reverse image of the magenta image is written.

Figure 30C:
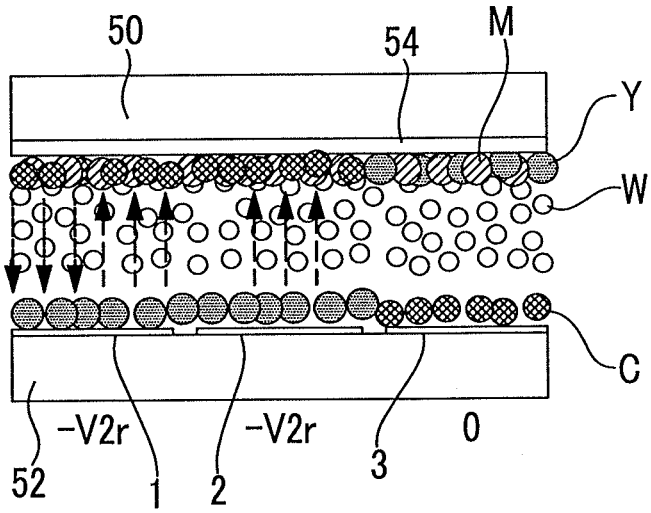

Then, as shown in FIG. 30C, a voltage $-V2r$ that is equal to or lower than the threshold voltage $-V2$ of the cyan particle C and is higher than the movement start voltage $-V3a$ of the magenta particle M is applied to the electrodes 1 and 2. That is, the voltage $-V2r$ satisfying $|V2|\leq|V2r|<|V3a|$ is applied to the electrodes 1 and 2 such that the cyan particles C which are arranged above the electrodes 1 and 2 so as to be close to the rear substrate 52 move to the display substrate 50. In this way, as shown in FIG. 28C, all cyan particles C which are arranged above the electrodes 1 and 2 so as to be close to the rear substrate 52 move to the display substrate 50 and the yellow particles Y which are arranged above the electrode 1 so as to be close to the display substrate 50 move to the rear substrate 52. In this way, the reverse image of the cyan image is written.

Figure 30D:
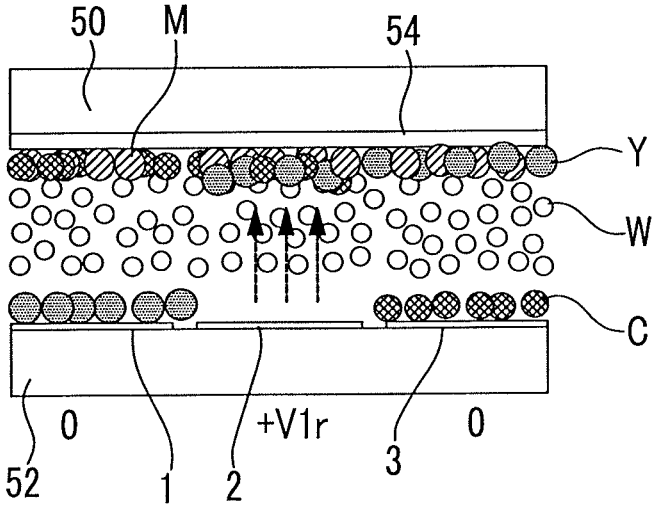

Then, as shown in FIG. 30D, a voltage $+V1r$ that is equal to or higher than the threshold voltage $+V1$ of the yellow particle Y and is lower than the movement start voltage $+V2a$ of the cyan particle C is applied to the electrode 2. That is, the voltage $+V1r$ satisfying $|V1|\leq|V1r|<|V2a|$ is applied to the electrode 2 such that the yellow particles Y which are arranged above the electrode 2 so as to be close to the rear substrate 52 move to the display substrate 50. In this way, as shown in FIG. 30D, all yellow particles Y which are arranged above the electrode 2 so as to be close to the rear substrate 52 move to the display substrate 50. In this way, the reverse image of the yellow image is written.

The subsequent processes are the same as those shown in FIGS. 29E to 29G described in the eleventh exemplary embodiment and thus the description thereof will not be repeated.

As such, in this exemplary embodiment, when the previously displayed image is reset, the reverse image of the image which is being displayed is sequentially displayed for each color of the particle groups with different colors in descending order of the threshold voltage and the reset voltage is applied such that the particle groups of each color move to the display substrate 50 or the rear substrate 52. Therefore, the non-uniform distribution of particles for each pixel due to the image which is displayed in the reset state is prevented.

The display devices according to the exemplary embodiments have been described above, but the invention is not limited to the above-described exemplary embodiments.

For example, a white particle group is used as a particle group which does not migrate, but the invention is not limited thereto. Any particle group with a color different from those of the first particle group 62 and the second particle group 64 may be used. For example, a black particle group may be used.

In the above-described exemplary embodiments, the display medium having a structure in which a dispersion medium is sealed between the substrates is used. However, a display medium in which there is a space (gas) between the substrates may be used.

The structure of the display device 100 (see FIG. 1) according to the above-described exemplary embodiments is an illustrative example. An unnecessary component may be removed or a new component may be added, without departing from the scope and spirit of the invention.

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. A driving device for driving a display medium that includes a pair of substrates and a plurality of particle groups which are provided between the pair of substrates and have different colors and different threshold voltages for separation from the substrates, comprising:

an application unit that applies reset voltages for moving the plurality of particle groups to one of the pair of substrates between the substrates, each reset voltage being different from each other according to each of the plurality of particle groups, wherein the reset voltages are applied sequentially to each of the plurality of particle groups; and a plurality of electrodes formed in a same plane on a surface of one of the pair of substrates, and configured to provide at least three different voltages.

2. The driving device for driving a display medium according to claim 1, wherein the application unit applies the reset voltages for moving each of the plurality of particle groups to the one substrate between the substrates according to an image which is being displayed.

3. The driving device for driving a display medium according to claim 2, wherein the application unit applies the reset voltages for moving each of the plurality of particle groups to the one substrate between the substrates in an order opposite to a display order of the plurality of particle groups when the image is displayed.

4. The driving device for driving a display medium according to claim 2, wherein the application unit sequentially applies the reset voltage corresponding to a reverse image of the image which is being displayed to each of the plurality of particle groups and applies the reset voltage for moving all of the plurality of particle groups to the one substrate.

5. The driving device for driving a display medium according to claim 1, wherein the application unit applies the reset voltages to each of the plurality of particle groups in ascending order of an absolute value of the threshold voltage.

6. The driving device for driving a display medium according to claim 1, wherein the application unit applies the reset voltages to each of the plurality of particle groups in descending order of an absolute value of the threshold voltage.

7. The driving device for driving a display medium according to claim 6, wherein the application unit applies the reset voltage to one of the plurality of particle groups for moving the particle group and applies the reset voltage to the particle group different from the one particle group according to the image which is displayed by the reset voltage.

8. The driving device for driving a display medium according to claim 1, wherein the application unit applies a voltage for reciprocating all of the plurality of particle groups between the substrates at least once after the reset voltages are applied.

9. The driving device for driving a display medium according to claim 1, wherein, for at least a portion of a period for which the reset voltage is applied to the one substrate, the application unit applies a voltage with a polarity opposite to that of the reset voltage to the other substrate.

10. The driving device for driving a display medium according to claim 1, wherein the display medium includes a dispersion medium with a color different from those of the plurality of particle groups between the substrates.

11. A display device comprising:

a display medium that includes a pair of substrates and a plurality of particle groups which are provided between the pair of substrates and have different colors and different threshold voltages for separation from the substrates; and the driving device for driving a display medium according to claim 1.

12. The display device according to claim 11, wherein the application unit applies reset voltages for moving each of the plurality of particle groups to the one substrate between the substrates according to an image which is being displayed.

13. The display device according to claim 12, wherein the application unit applies the reset voltages for moving each of the plurality of particle groups to the one substrate between the substrates in an order opposite to a display order of the plurality of particle groups when the image is displayed.

14. The display device according to claim 12, wherein the application unit sequentially applies the reset voltage corresponding to a reverse image of the image which is being displayed to each of the plurality of particle groups and applies the reset voltage for moving all of the plurality of particle groups to the one substrate.

15. The display device according to claim 11, wherein the application unit applies the reset voltages to each of the plurality of particle groups in ascending order of an absolute value of the threshold voltage.

16. The display device according to claim 11, wherein the application unit applies the reset voltages to the plurality of particle groups in descending order of an absolute value of the threshold voltage.

17. The driving device for driving a display medium according to claim 1, wherein the display medium is divided into cells separated by spacers, each cell including a plurality of electrodes formed in a same plane on a surface of one of the pair of substrates, and wherein at least two of the plurality of particle groups have a same polarity.

18. A method of driving a display medium that includes a pair of substrates and a plurality of particle groups which are provided between the pair of substrates and have different colors and different threshold voltages for separation from the substrates, the method comprising:

applying reset voltages for moving the plurality of particle groups to one of the pair of substrates between the substrates, each reset voltage being different from each other according to each of the plurality of particle groups;

wherein the reset voltages are applied sequentially to each of the plurality of particle groups; and forming a plurality of electrodes in a same plane on a surface of one of the pair of substrates, the plurality of electrodes being configured to provide at least three different voltages.

19. The method of driving the display medium according to claim 18, wherein, in the application of the reset voltages, the reset voltages for moving the plurality of particle groups to the one substrate is applied between the substrates according to an image which is being displayed.

20. A display method comprising:

for a display medium that includes a pair of substrates and a plurality of particle groups which are provided between the pair of substrates and have different colors and different threshold voltages for separation from the substrates, applying reset voltages for moving the plurality of particle groups to one of the pair of substrates between the substrates, each reset voltage being different from each other according to each of the plurality of particle groups, the reset voltages are applied sequentially to each of the plurality of particle groups; and forming a plurality of electrodes in a same plane on a surface of one of the pair of substrates, the plurality of electrodes being configured to provide at least three different voltages.

21. The display method according to claim 20, wherein, in the application of the reset voltages, the reset voltage for moving the plurality of particle groups to the one substrate is applied between the substrates according to an image which is being displayed.

* * * * *